US011318064B2

(12) United States Patent
Haddock DiCarlo et al.

(10) Patent No.: US 11,318,064 B2
(45) Date of Patent: May 3, 2022

(54) PRESSURE FIELD STIMULATION DEVICE

(71) Applicant: Uccellini Inc., Bend, OR (US)

(72) Inventors: Lora LeeAnne Haddock DiCarlo, Bend, OR (US); Lola Vars, Corvallis, OR (US); Ada-Rhodes Short, Corvallis, OR (US); Avery Smith, Albany, OR (US); Kim Porter Henneman, Bend, OR (US); Douglas S. Layman, Bend, OR (US); Blake Michael Larkin, Eugene, OR (US); Mark Hazelton, Philomath, OR (US); Mazie Houchens, Corvallis, OR (US)

(73) Assignee: Uccellini Inc., Bend, OR (US)

( * ) Notice: Subject to any disclaimer, the term of this patent is extended or adjusted under 35 U.S.C. 154(b) by 365 days.

(21) Appl. No.: 16/569,697

(22) Filed: Sep. 13, 2019

(65) Prior Publication Data

US 2020/0085676 A1 Mar. 19, 2020

Related U.S. Application Data

(63) Continuation-in-part of application No. 29/695,752, filed on Jun. 21, 2019, now Pat. No. Des. 898,937, (Continued)

(51) Int. Cl.
*A61H 19/00* (2006.01)
*A61H 23/02* (2006.01)

(52) U.S. Cl.
CPC ..... *A61H 19/34* (2013.01); *A61H 23/0254* (2013.01); *A61H 2201/0157* (2013.01); *A61H 2201/5097* (2013.01)

(58) Field of Classification Search
CPC ..... A61H 19/00; A61H 19/30; A61H 19/34; A61H 19/50; A61H 23/0254
See application file for complete search history.

(56) References Cited

U.S. PATENT DOCUMENTS 6,099,463 A 8/2000 Hockhalter
6,733,438 B1 5/2004 Dann et al.
(Continued)

FOREIGN PATENT DOCUMENTS

AU 2018200317 A1 2/2018
WO 2011094799 A1 8/2011
(Continued)

OTHER PUBLICATIONS

Rodriguez, Ariana, "Womanizer Releases New Products, hits Sales Milestone", XBIX.com, Jan. 19, 2018, 13 pgs.
(Continued)

*Primary Examiner* — John P Lacyk
(74) *Attorney, Agent, or Firm* — Maxine Lynn Barasch; Dreamweaver Law, PLLC

(57) ABSTRACT

Embodiments of the improved stimulation device include a cup and a driver. The cup has a cavity surrounded by a rim. The driver comprises a plate disposed on an underside of the cup, a cam disposed adjacent to the plate, and a motor mechanically coupled to the cam. The driver is configured to intermittently vary a volume of the cavity of the cup from a first volume to a second volume without returning the cup from the second volume to the first volume. In some embodiments, the cup returns from the second volume to the first volume, in between intermittent varying from the first volume to the second volume, due to the resilient nature of the material of the cup and/or the configuration of the cup. This varying of the volume between the first and second volumes creates a pressure field in a chamber formed by the cavity and a user's skin.

25 Claims, 34 Drawing Sheets

Related U.S. Application Data and a continuation-in-part of application No. 29/675,567, filed on Jan. 3, 2019, now Pat. No. Des. 884,206.

(60) Provisional application No. 62/869,008, filed on Jun. 30, 2019, provisional application No. 62/868,266, filed on Jun. 28, 2019, provisional application No. 62/868,203, filed on Jun. 28, 2019, provisional application No. 62/868,232, filed on Jun. 28, 2019, provisional application No. 62/868,218, filed on Jun. 28, 2019, provisional application No. 62/868,312, filed on Jun. 28, 2019, provisional application No. 62/868,331, filed on Jun. 28, 2019, provisional application No. 62/868,247, filed on Jun. 28, 2019, provisional application No. 62/868,279, filed on Jun. 28, 2019, provisional application No. 62/787,930, filed on Jan. 3, 2019, provisional application No. 62/731,836, filed on Sep. 15, 2018, provisional application No. 62/731,840, filed on Sep. 15, 2018, provisional application No. 62/731,839, filed on Sep. 15, 2018, provisional application No. 62/731,838, filed on Sep. 15, 2018, provisional application No. 62/731,835, filed on Sep. 15, 2018.

(56) References Cited

U.S. PATENT DOCUMENTS

| | | | |
|---|---|---|---|
| 7,530,944 | B1 | 5/2009 | Kain |
| 8,579,837 | B1 | 11/2013 | Makower et al. |
| 9,763,851 | B2 | 9/2017 | Lenke |
| 9,849,061 | B2 | 12/2017 | Lenke |
| 9,937,097 | B2 | 4/2018 | Lenke |
| D825,073 | S | 8/2018 | Lenke |
| D848,013 | S | 5/2019 | Fuhner et al. |
| 2003/0176817 | A1 | 9/2003 | Chang |
| 2005/0240122 | A1 | 10/2005 | Gander et al. |
| 2005/0256369 | A1 | 11/2005 | Doth |
| 2005/0273024 | A1 | 12/2005 | Nan |
| 2008/0071138 | A1 | 3/2008 | Mertens et al. |
| 2013/0012769 | A1 | 1/2013 | Carlson |
| 2015/0196455 | A1 | 7/2015 | Mertens et al. |
| 2016/0022532 | A1 | 1/2016 | Makeower et al. |
| 2016/0213557 | A1 | 7/2016 | Lenke |
| 2017/0027809 | A1 | 2/2017 | Lenke |
| 2017/0065483 | A1 | 3/2017 | Lenke |
| 2017/0216135 | A1 | 8/2017 | Lenke |
| 2017/0281457 | A1 | 10/2017 | Witt |
| 2018/0092799 | A1 | 4/2018 | Lenke |
| 2018/0153764 | A1 | 6/2018 | Lenke |
| 2018/0243161 | A1 | 8/2018 | Lenke |
| 2018/0243162 | A1 | 8/2018 | Lenke |

FOREIGN PATENT DOCUMENTS

| | | | |
|---|---|---|---|
| WO | 2013067367 | A1 | 5/2013 |
| WO | 2014085736 | A1 | 6/2014 |
| WO | 2017158107 | A1 | 9/2017 |

OTHER PUBLICATIONS

"IRRESISTIBLE", by Shots, www.ean-online.com/ebooks/EAN_06_2019, 2019, 1 pgs.

"Shots—Irresistible—Mythical—Touchless Clotorial Stimulation", www.youtube.com/watch?v=9hjxKpQBCVU, May 31, 2019, 4 pgs.

"Shots—Irresistible Collection—Promo" https://www.youtube.com/watch?v=ixi_jvwV8g8, Mar. 26, 2019, 1 pg.

Copenheaver, Blane R., PCT/US2019/050930, PCT Search Report dated Nov. 18, 2019, UCC-0020-PCT, 12 pgs.

Eaton, Kit, "New Sasi Sex Toy Gets Intelligent With Your Nether Regions", Gizmodo, https://gizmodo.com/new-sasi-sex-toy-gets-intelligent-with-your-nether-regi-346406, Jan. 18, 2008, 4 pgs.

Sloan, Kate, "Review: JeJoue Sasi", Girlyjuice, https://girlyjuice.net/review-jejoue-sasi/, Mar. 11, 2013, 2 pgs.

Sutra, Cara, Je Joue Sasi Review (& Lelo Ora Oral Sex Simulator Comparison), Carasitra, https://carasutra.com/review/je-joue-sasi-review-lelo-ora-oral-sex-simulator-comparison/, Feb. 24, 2014, 6 pgs.

Alptraum, Lux, "The Vibrator of the Future Won't Vibrate", Motherboard Tech by Vice, https://www.vice.com/en_us/article/qkjz8x/the-vibrator-of-the-future-wont-vibrate, Jul. 14, 2016, 6 pgs.

"Je Joue SaSi Vibrator, Plum", Amazon, https://camelcamelcamel.com/Je-Joue-SaSi-Vibrator-Plum/product/B002T5LKMQ, 2010, 5 pgs.

"Je Joue Sasi, Tongue Massager", AliExpress, https://www.aliexpress.com/item/552706705.html, 2008, 5 pgs.

"SASI Product", 2008, 5 pgs.

PRESSURE FIELD STIMULATION DEVICE

FIELD

Embodiments of the invention relate to a stimulation device, and more particularly, to an air pressure field stimulation device.

BACKGROUND

Stimulation of skin has many beneficial effects, including raising blood flow in the area, and stimulating nerve endings. In addition, on a human body, a vulva includes organs including a clitoris, mons pubis, labia majora, and labia minora surrounding the vagina. The glans clitoris is a portion of the clitoris that is on the vulva, external to the vagina. The glans clitoris has thousands of nerve endings, and the vulva is sexually responsive. Stimulation of a person's glans clitoris increases blood flow to the area and provides sexual pleasure. There exists a need for improvements in personal massagers that can provide increased stimulation.

SUMMARY

Disclosed embodiments provide an improved stimulation device. Embodiments of the improved stimulation device include a cup and a driver. The cup has a cavity surrounded by a rim. In use, a user positions the rim such that an opening to the cavity is over an area of a user's body to be stimulated (for example, the clitoris). A sealed, or substantially-sealed, chamber is formed by the cavity walls and the user's body (for example, skin surrounding the clitoris). A driver is configured to vary a volume of a cavity of a cup from a first volume to a second volume. The cup returns from the second volume to the first volume, in between intermittent varying from the first volume to the second volume, due to a buckle region wall of the cup springing out. In some embodiments, the cup returning from the second volume to the first volume is achieved without a force external to the cup structure, such as electrical assistance or mechanical assistance from another article or device. This cyclical varying of the volume between the first and second volumes creates a pressure field in the chamber. The springing out of the buckle region also produces a "thud" or "thump," which is imparted to the user. In some embodiments, the stimulation device is a sex toy. In some embodiments, the stimulation device is a medical device.

In some embodiments, there is provided a stimulation device, comprising: a cup formed of a flexible resilient material comprising a cavity; and a driver, the driver comprising: a plate disposed on an underside of the cup; a cam disposed adjacent to the plate; a motor mechanically coupled to the cam; wherein the cam is not permanently connected to the plate.

In some embodiments, there is provided a stimulation device, comprising: a cup formed of a flexible resilient material comprising a cavity; a driver, the driver comprising: a plate disposed on an underside of the cup; a cam disposed adjacent to the plate; and a motor mechanically coupled to the cam; a processor; and a memory containing instructions that when executed by the processor cause the driver to intermittently vary a volume of the cavity of the cup from a first volume to a second volume.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1A:
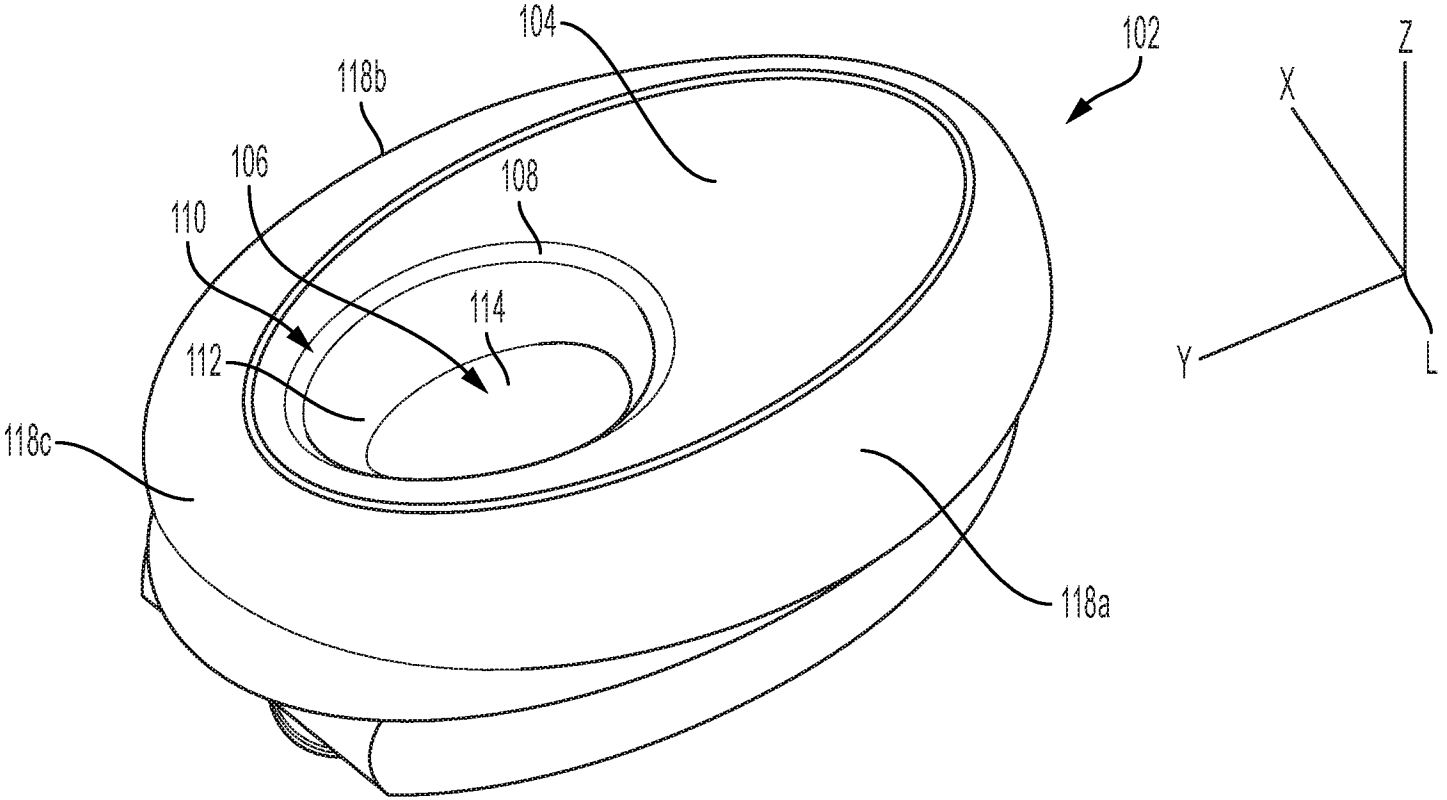
FIG. 1A is a perspective view of an example cup in accordance with some embodiments of the present invention.

The drawings are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

DETAILED DESCRIPTION

Disclosed embodiments provide an improved stimulation device. Embodiments of the improved stimulation device include a cup and a driver. The cup has a cavity surrounded by a rim. In use, a user positions the rim such that an opening to the cavity is over an area of a user's body to be stimulated (for example, the clitoris). A sealed, or substantially-sealed, chamber is formed by the cavity walls and the user's body (skin surrounding the clitoris). A driver is configured to vary a volume of a cavity of a cup from a first volume to a second volume. The cup returns from the second volume to the first volume, in between intermittent varying from the first volume to the second volume, due to a buckle region wall of the cup springing out. In some embodiments, the cup returning from the second volume to the first volume is achieved without a force external to the cup structure, such as electrical assistance or mechanical assistance from another article or device. This cyclical varying of the volume between the first and second volumes creates a pressure field in the chamber. The springing out of the buckle region also produces a "thud" or "thump" (used interchangeably herein) which is imparted to the user. In some embodiments, the stimulation device is a sex toy. In some embodiments, the stimulation device is a medical device.

Reference throughout this specification to "one embodiment," "an embodiment," "some embodiments", "embodiments," or similar language means that a particular feature, structure, or characteristic described in connection with the embodiment is included in at least one embodiment of the present invention. Thus, appearances of the phrases "in one embodiment," "in an embodiment," "in some embodiments", "in embodiments," and similar language throughout this specification may, but do not necessarily, all refer to the same embodiment.

Moreover, the described features, structures, or characteristics of the invention may be combined ("mixed and matched") in any suitable manner in one or more embodiments. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, and/or elements.

For the purposes of disclosure, the word, "substantially" is defined as "for the most part". It means "to a great extent," but having some room for some minor variation.

Throughout this disclosure, a legend "L" is used to indicate orientation of the various views of disclosed embodiments with respect to an X, Y, and Z axis.

FIG. 1A is a perspective view of an example cup 102 in accordance with some embodiments of the present invention. Cup 102 includes a cavity 106. In some embodiments, cavity 106 is sized and configured to fit over a region of skin of a user's body. In some embodiments, the cavity is sized and configured to fit over the region of skin on a vulva surrounding a glans clitoris of a user (note that although described herein with respect to clitoral stimulation, it should be recognized that embodiments may be used for stimulation of any suitable body part). Cavity 106 has a rim 108 defining an opening 110 of the cavity. Cavity 106 is defined by an interior lateral wall 112 and a base 114 (bottom in the orientation shown). The lateral wall 112 and base 114 may together be a single continuous substantially-rounded concave wall, or may include edges between flat surfaces. The cavity 106 may be any suitable shape. In some embodiments, cavity 106 is oval in shape as shown here. In some embodiments, lateral wall 112 and base 114 are comprised of a single continuous material with the cup 102.

The cup's cavity 106 is adapted such that when rim 108 is placed on the skin of a user with the opening 110 over the area to be stimulated, a chamber filled with air is formed among the cavity walls 112, base 114, and the user's skin. The chamber is preferably substantially-sealed. Note that although herein, a "chamber" is referred to, in some embodiments, the chamber is comprised of several separate but connected compartments, such that air can flow between the compartments. Accordingly, the use of the word "chamber" in the singular is not meant to exclude split-chamber or multi-chamber configurations. "Pressure" as used herein refers to air pressure.

In some embodiments, the cup 102 additionally has a wing region formed thereon. There may be side wings 118*a*, 118*b* on each side of the cup 102, as well as a front wing 118*c*. In use for stimulation of a vulva, front wing 118*c* extends under the labia and under the mons pubis of a user to assist in holding the cup 102 to the skin of the user. This creates an improved seal of the chamber. Side wings 118*a* and 118*b* make contact with the labia during use for an improved seal and stimulation of the labia. Some embodiments may further include a basin 104 for improved seal.

Figure 1B:
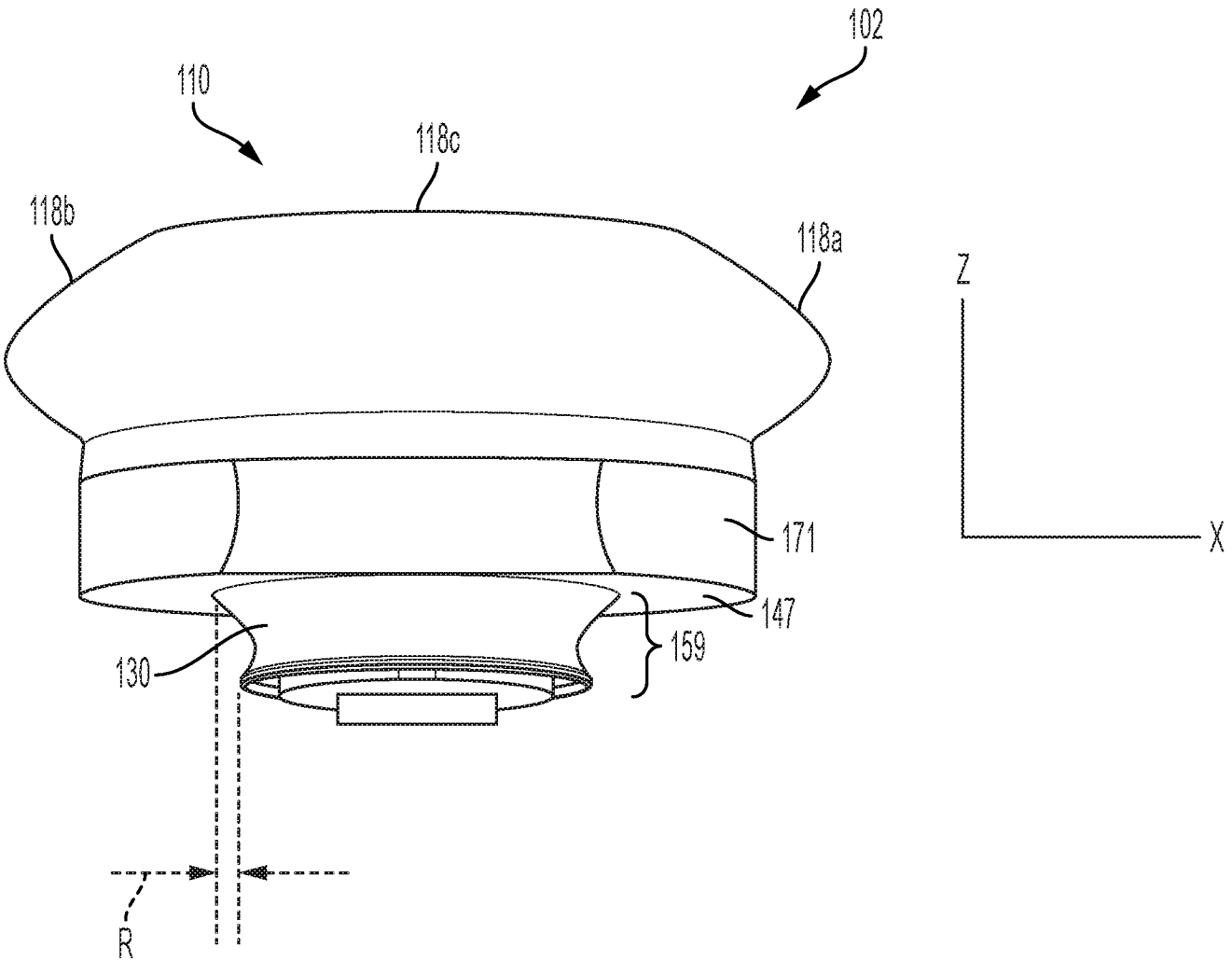
FIG. 1B shows a front view of the cup of FIG. 1A.

FIG. 1B shows a front view of the cup 102 of FIG. 1A. In this view, the wing regions 118*a*, 118*b*, and 118*c* are prominently shown. A buckle region wall 130 and an anchor wall 171 of cup 102 are in view. The buckle region wall 130 compresses and uncompresses (i.e. expands) during operation of the stimulation device, resulting in a variable volume of the cavity 106 (FIG. 1) of cup 102. The anchor wall 171 serves as an anchor for the buckling of the buckle region wall 130. The buckle region wall 130 forms a resilient protrusion 159 that extends from the underside (floor) 147 of the anchor wall 171 of the cup 102.

Figure 1C:
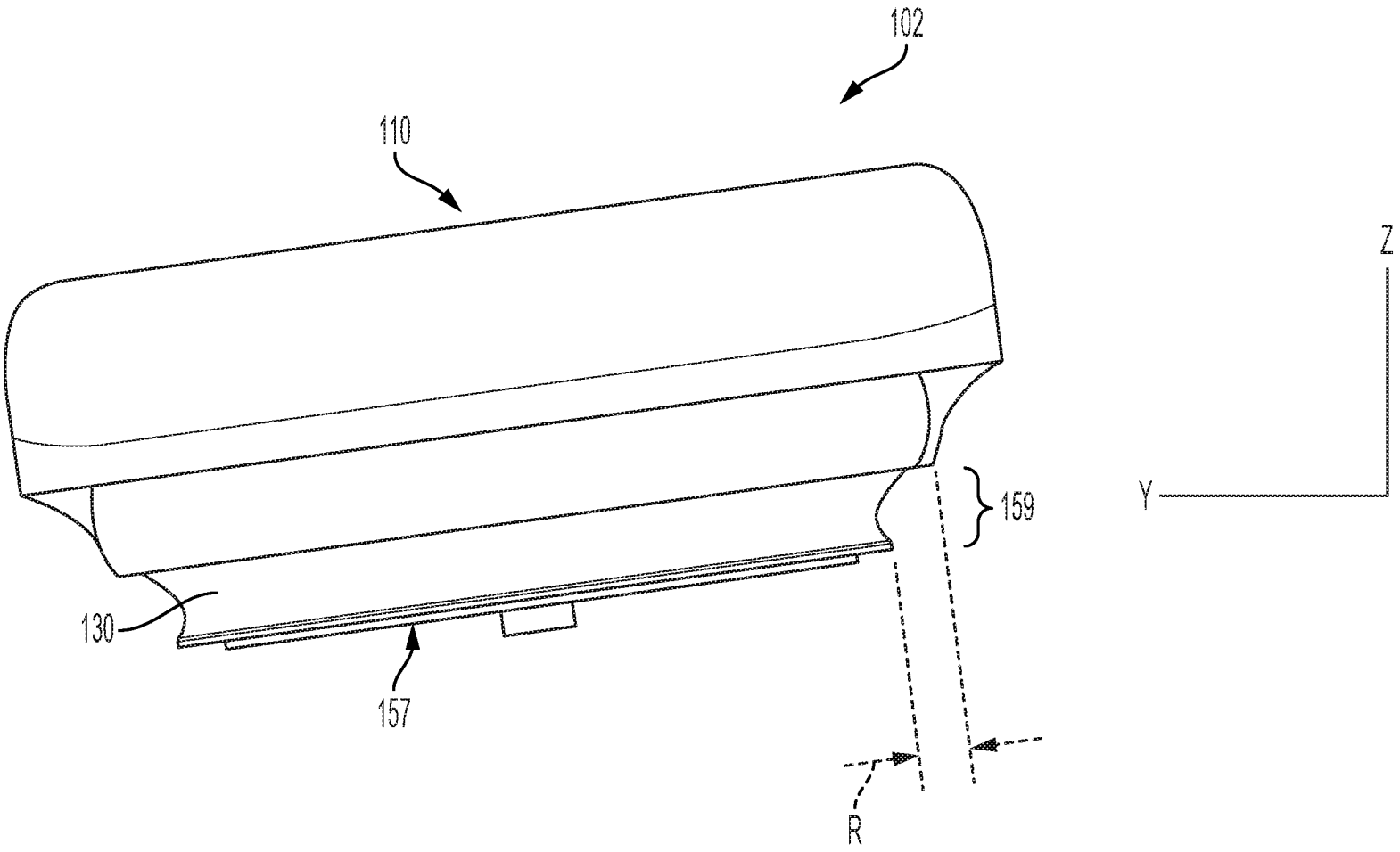
FIG. 1C is a side view of the cup of FIG. 1A.

FIG. 1C is a side view of the cup 102 of FIG. 1A. The opposite side of the cup 102 looks symmetrical in embodiments. Referring also to FIG. 1B, the buckle region wall 130 forms a resilient protrusion 159, which is the buckle region, that extends from the underside 147 of the anchor wall 171 of cup 102.

Figure 1D:
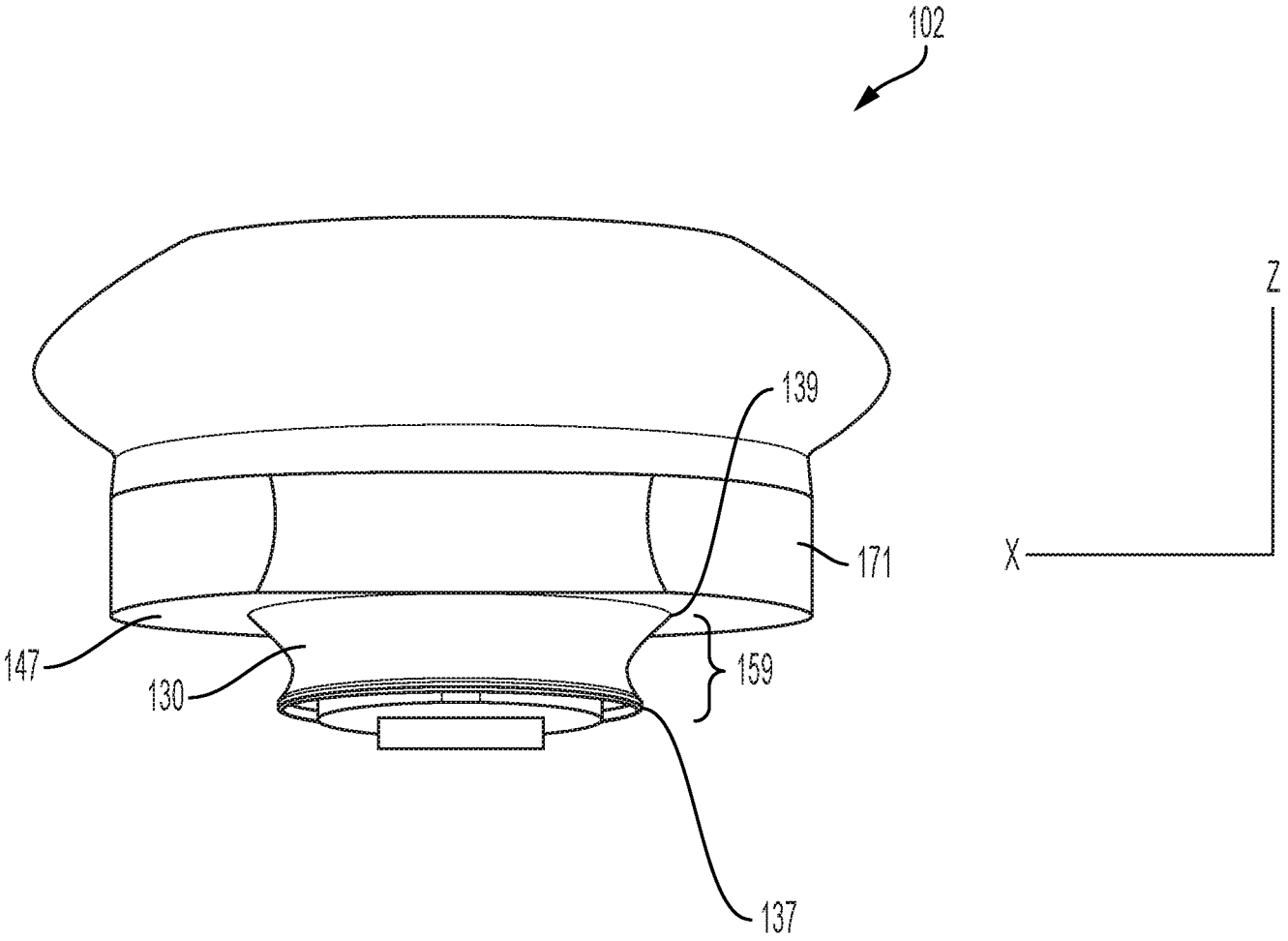
FIG. 1D shows a rear view of the cup of FIG. 1A.

FIG. 1D shows a rear view of the cup 102 of FIG. 1A. The buckle region wall 130 is in view with a first edge 139 and a second edge 137. First edge 139 is an upper exterior edge and second edge is a lower exterior edge ("exterior" is only used to denote that these edges are on the exterior of the cup, rather than interiorly inside the cavity). "Upper" and "lower" are used in describing in the orientation shown, but not mean to be limiting. Buckle region wall 130 protrudes from the underside surface 147 of the anchor wall 171 of cup 102, and forms the protrusion 159. Anchor wall 171 has a wall thickness larger than the wall thickness of buckle region wall 130.

Figure 1E:
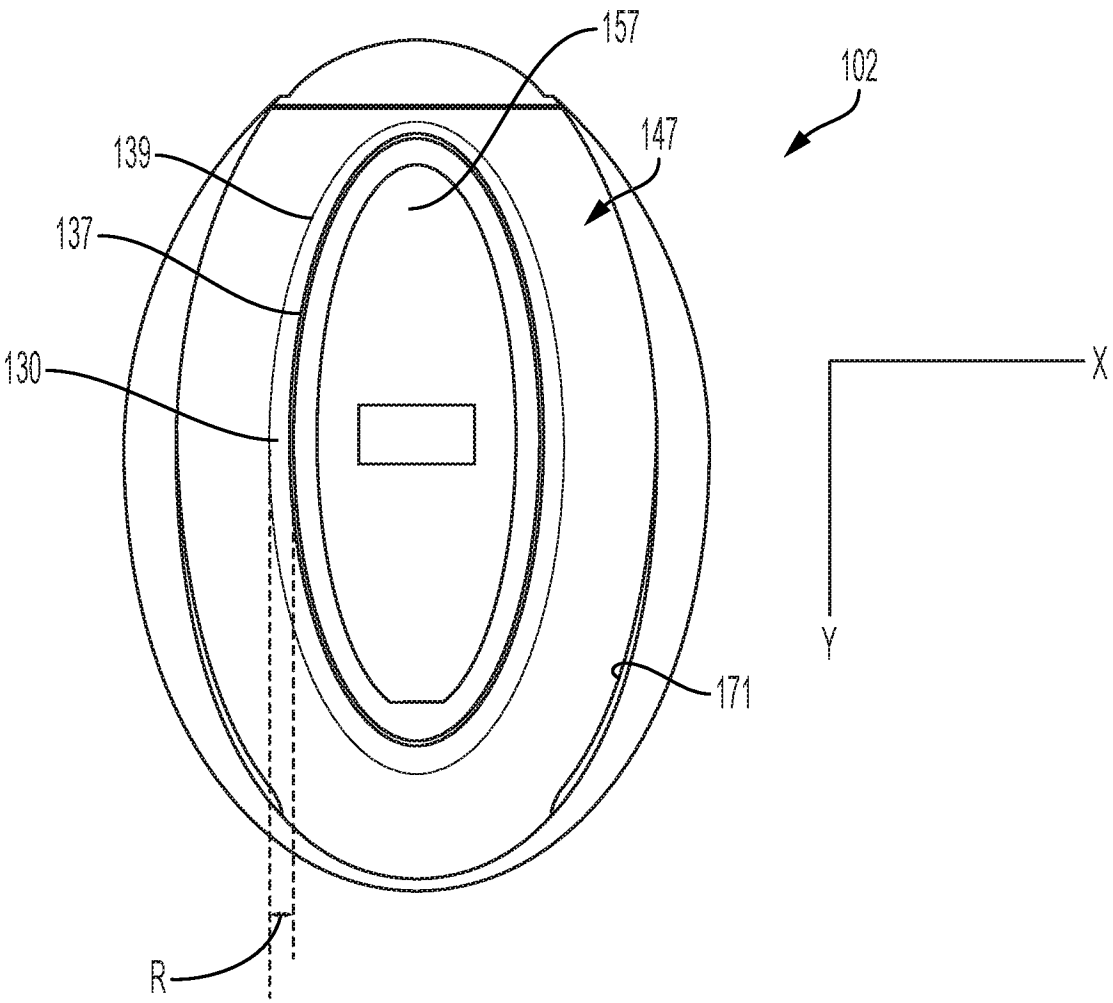
FIG. 1E is a bottom-up view of the cup of FIG. 1A.

FIG. 1E is a bottom-up view of the cup 102 of FIG. 1A. The buckle region is in view with the first edge 139 and the second edge 137 shown. A reveal R between edges 137 and 139 is configured to assist the buckle wall region in buckling under a compression force (also referred to herein interchangeably with "push force") from a driver. The buckling of buckle region wall 130 typically occurs prior to any warping of anchor wall 171. In some embodiments, the anchor wall 171 does not buckle or warp. In some embodiments, the anchor wall 171 does not substantially buckle or warp. The buckle wall region wall 130 is also configured such that it will spring back out to default (i.e. extended/relaxed) position when the compression force is removed. The reveal is the difference in the X and Y dimensions, between the edge 137 and the edge 139, as indicated in FIG. 1B, FIG. 1C, and FIG. 1E. In the embodiment shown, R is equal around the perimeters of edges 137 and 139. In other embodiments, R could have some irregularities.

In some embodiments, the buckle region wall 130 is concave in shape on its exterior surface. Thus, in some embodiments, the buckle region wall 130 has a concave exterior surface. In some embodiments, the first edge 139 is of a larger perimeter than the second edge 137. This creates the reveal R. In embodiments, the ovular shape outlined by the second edge 137 is oriented concentrically with respect to the ovular shape outlined by the first edge 139. In some embodiments, the buckle region 130 is formed with an ovular shape as shown in FIG. 1E. In some embodiments, the buckle region is of a shape other than an oval. Any suitable shape is included within the scope of the invention.

The buckle wall region 130, with reveal R, is also configured such that it will spring back out to default (i.e. extended/relaxed) position when the compression force is removed. The buckle region wall 130 is made of a material that, when the second edge 137 is compressed towards the first edge 139 by a force of a mechanical member such as a cam of a driver, and then the force is subsequently removed from the second edge 137, the buckle region 137 quickly/abruptly returns to its default position (expanded position) with a spring-like motion. The buckle region behaves similar to a spring having a spring constant that causes the buckle region wall to abruptly return to its default position once the driver force is removed.

The cup 102 (and, therefore, cavity lateral wall 112 and base 114) is preferably comprised of a non-permeable flexible resilient material. In some embodiments, the flexible resilient material has a Shore durometer value ranging from A5 to D60. In some embodiments, the flexible resilient material has a Shore durometer value ranging from A10 to D40. In some embodiments, the cup is comprised of silicone. In some embodiments, the cup is comprised of rubber, TPE, plastic, or other suitable material.

Figure 1F:
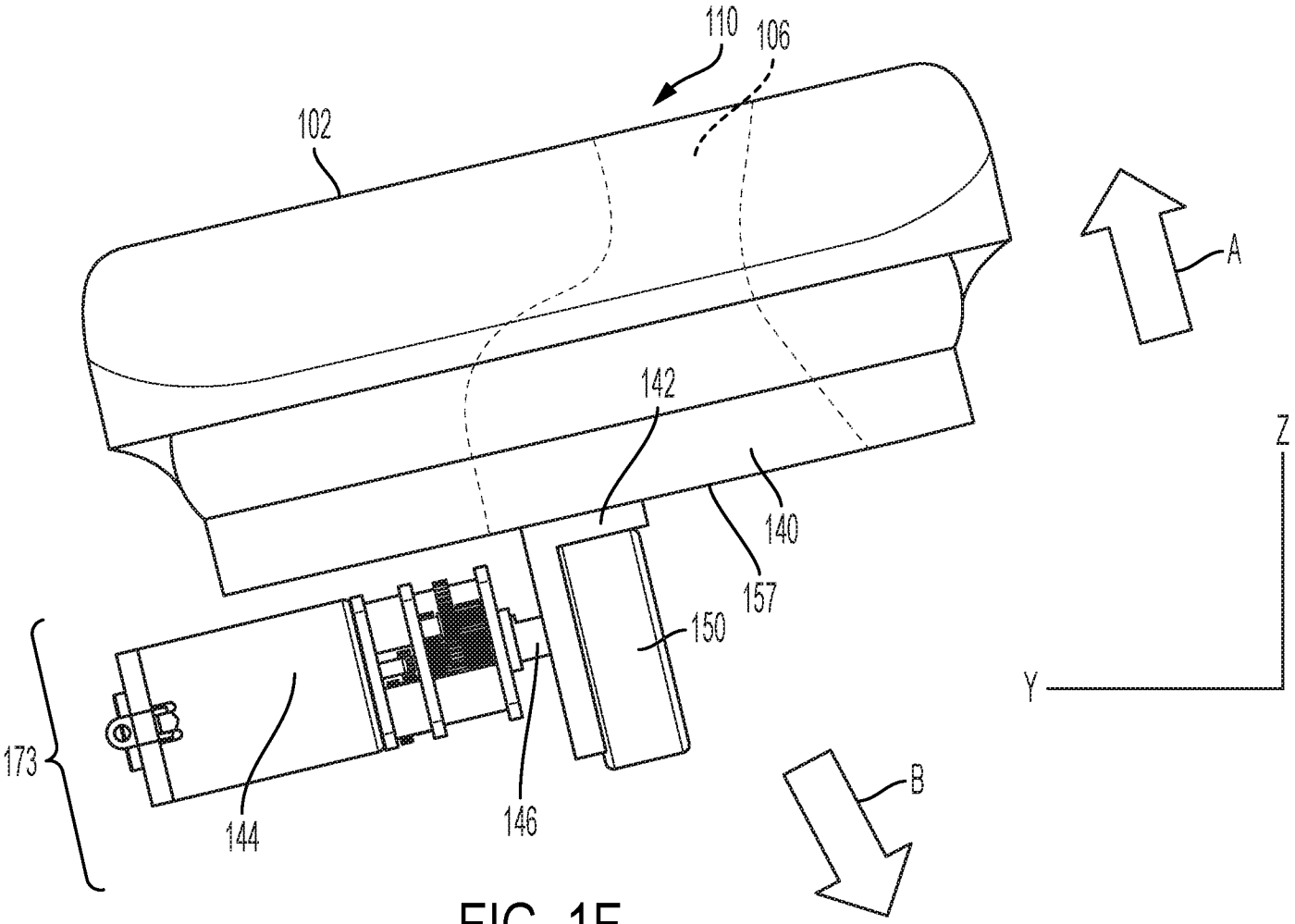
FIG. 1F shows an example cup and driver assembly.

FIG. 1F shows cup 102 with an example driver assembly. In some embodiments, the underside 157 is rigid enough to function as the plate of a driver. Additional driver components including a motor 144 and cam 150 are also shown. Accordingly, the components of the driver 173 are the same as 239 in FIGS. 2A-2D, except a plate can be integral (or monolithic) with the underside of the buckle region wall 130. In such instances, the underside 157 is rigid, and may be a silicone of a Shore durometer value ranging from A20 to D60, while the buckle region wall 130 of the cup is resilient, being of a Shore durometer value ranging from A5 to D30. In embodiments, the underside 157 is moved by the driver in direction indicated by arrow A, and the underside 157 returns in direction B. In some embodiments, a separate plate, such as 140 of FIGS. 2A-2D or 740 of FIG. 7A-7E, is connected to underside 157 on underside of buckle region wall 130, so the underside 157 does not have to be rigid.

Figure 2A:
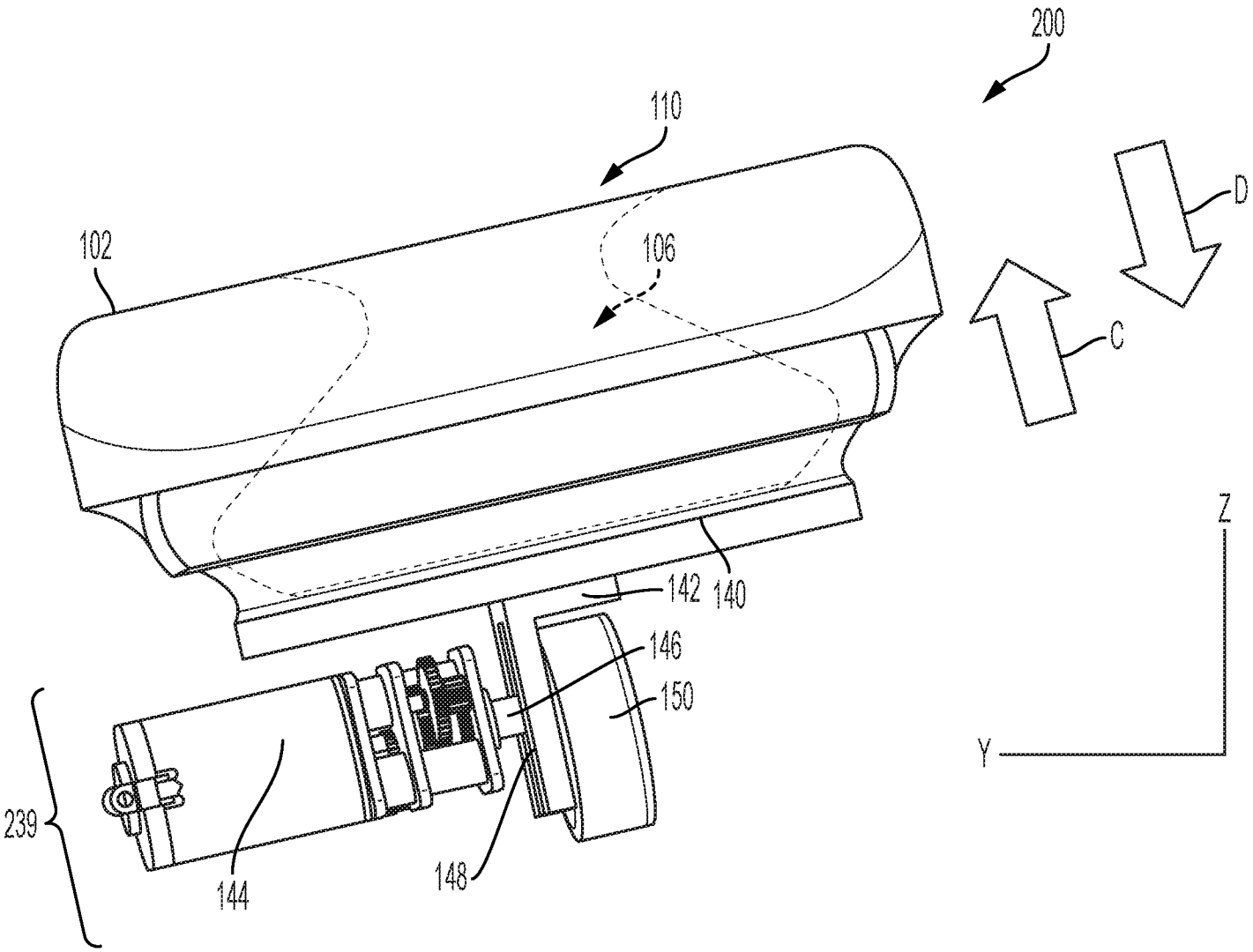
FIG. 2A is a side view of an embodiment 200 of example cup and example driver assembly in accordance with some embodiments of the present invention where the buckle region wall 130 is in default position.
Figure 2B:
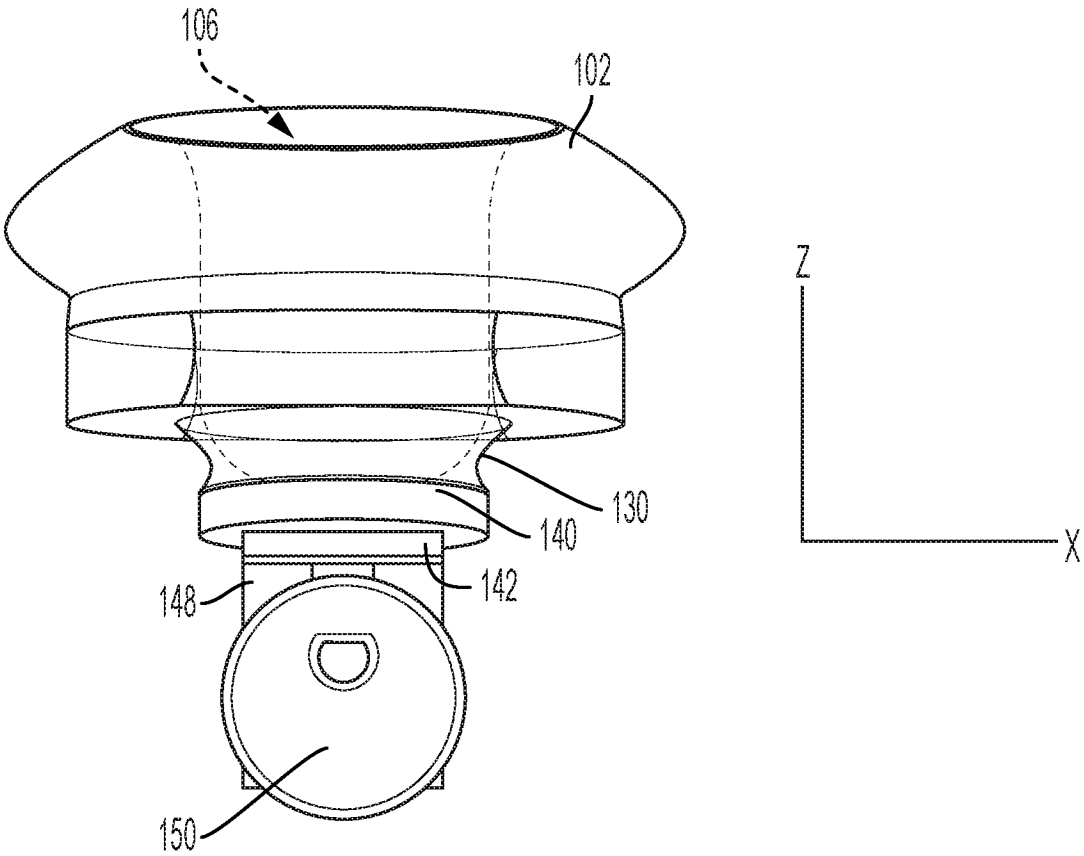
FIG. 2B is a front view of the cup and driver assembly in accordance with some embodiments of the present invention where the buckle region wall 130 is in default position.
Figure 2C:
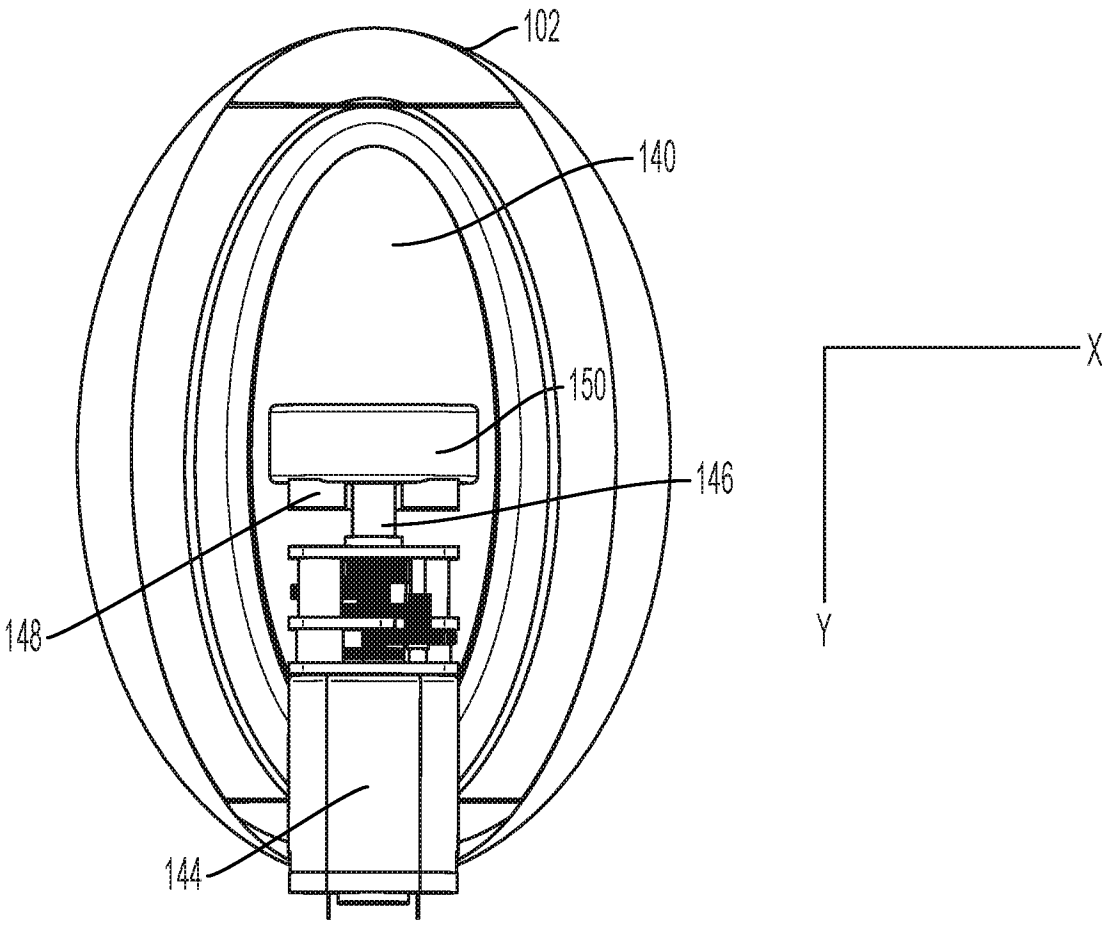
FIG. 2C is a bottom view of the cup and driver assembly in accordance with some embodiments of the present invention.
Figure 2D:
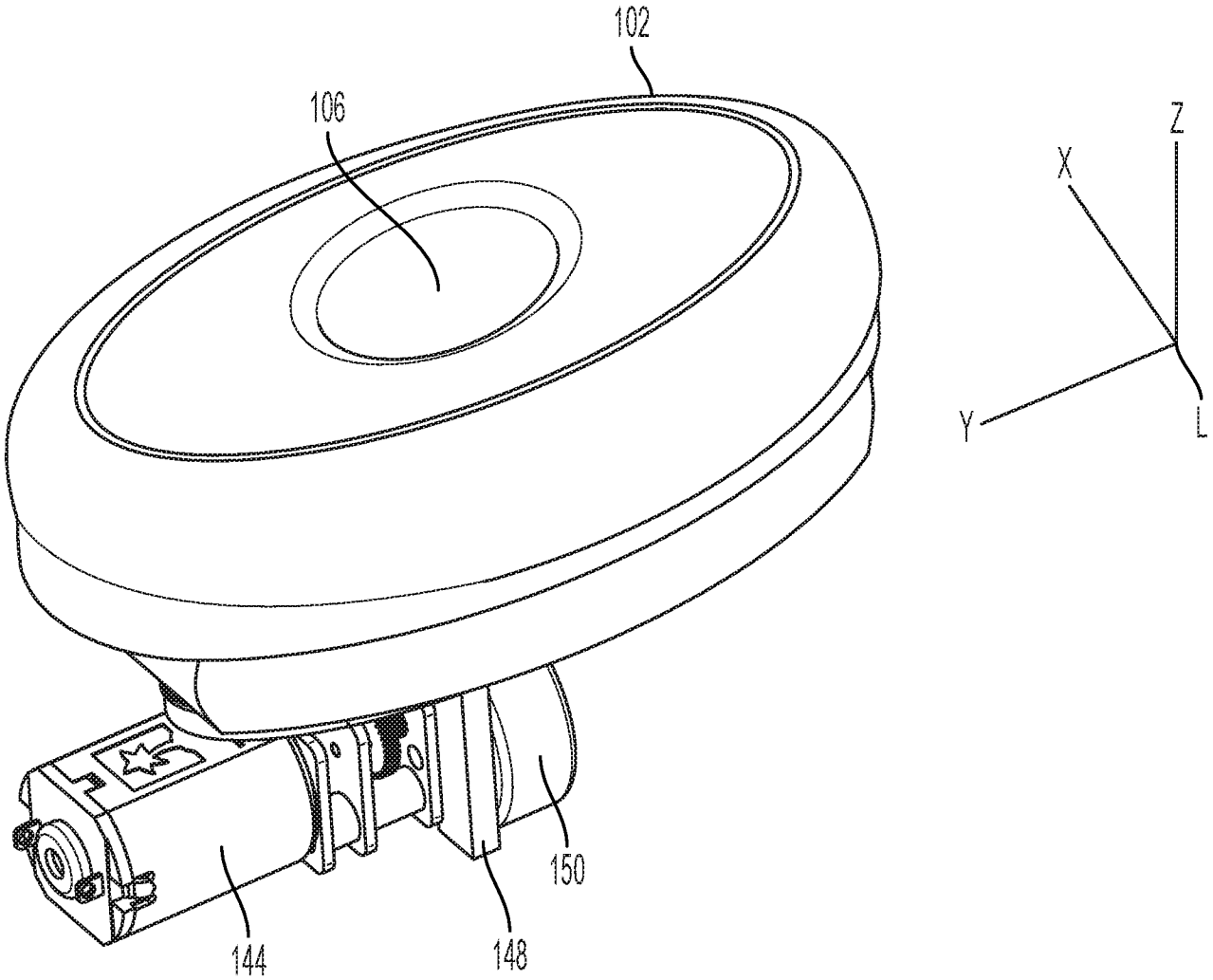
FIG. 2D is a perspective view of the cup and driver assembly in accordance with some embodiments of the present invention.

FIG. 2A is a side view of an embodiment 200 of example cup and driver assembly in accordance with some embodiments of the present invention where the buckle region wall 130 is in default position. FIG. 2B is a front view of the cup and driver assembly in accordance with some embodiments of the present invention where the buckle region wall 130 is in default position. FIG. 2C is a bottom view of the cup and driver assembly in accordance with some embodiments of the present invention. FIG. 2D is a perspective view of the cup and driver assembly in accordance with some embodiments of the present invention.

Referring now to FIGS. 2A-2D, there is shown a driver assembly 239 comprising a plate 140, a cam 150, and a motor 144. In embodiments, there is a cam 150 disposed adjacent to the plate 140. In embodiments, although the cam 150 and the plate 140 intermittently make contact with one another, they are not permanently connected to one another. In embodiments, the plate 140 is disposed on an underside surface (157 of FIG. 1E) of the buckle region wall 130 of the cup. Plate 140 may be adhered, welded, integral with, pinned, or otherwise connected with the underside of the cup. In embodiments, the driver also includes any additional mechanical coupling such as gears, pullies, shafts, and/or other devices to impart motion to components of the pressure field stimulation device. In some embodiments, the plate 140 is rigid, or substantially-rigid. It can have some flexibility, but must have a hardness such that the cam 150 can vary the position of the plate 140. The hardness/flexibility of the cup as compared with that of the plate is such that when the cup puts a force on the plate, the plate does not flex. In some embodiments, the plate 140 is comprised of plastic, metal, silicone, and/or other suitable material. In embodiments, the cam 150 is rigid or substantially rigid such that it can apply a push force on the plate 140. The push force is a force that can result in compression of a portion of the cup, such as the buckle region wall 130 of the cup 102. In embodiments, the cam 150 is made of plastic, metal, or other suitable material.

In some embodiments, motor 144 is configured such that a motor shaft 146 is disposed within a motor shaft guide (comprised of a flange on each side of the motor shaft 146) 148. The shaft guide 148 keeps the alignment of the plate 140 above the cam 150, ensuring that the force of the cam 150 is toward the plate 140, minimizing force to the sides. A cam 150 is mechanically coupled to the motor 144 via shaft 146. In some embodiments, the plate has a connected, integral, or monolithic cam strike 142. The cam strike may be a protrusion from the plate, to which contact is made by the cam 150. In some embodiments, a cam strike portion is not present, and the cam 150 contacts a substantially-flat portion of the underside of the plate 140.

During operation, the motor rotates the cam 150. During the rotation cycle, cam 150 makes intermittent contact with the cam strike 142 (or plate 140), which pushes plate 140 in direction C (on FIG. 2A) to cause compression of the buckle region wall 130 of cup 102, bringing cavity 106 from a first volume (V1) to a second volume (V2). When the cam 150 continues to rotate, it eventually abruptly loses contact with the plate 140 (or cam strike 142, if present). In order to abruptly remove the push force from the underside of the cup 102, the cam 150 rotates at a speed such that the contact edge of the cam 150 is moved away from the plate 140 faster than the buckle region wall 130 can spring back to its default position. During this time of non-contact, the buckle region 130 of cup 102 expands in direction D, or "springs" out, to the first volume (V1). The expansion is due to the configuration of the buckle region wall 130 (without electrically-assisted pull or push). The driver does not pull or push it to spring back. The volume of the cavity is varied as the buckle region wall 130 changes positions cyclically (i.e. repeatedly), creating a pressure field in the chamber.

Various settings are associated with corresponding speeds of the driver (e.g., rotations per minute of the cam). Accordingly, a user may choose that the pressure field stimulation device generate greater or lower pressure for their comfort level. The higher the speed, generally, the more intense the stimulation, and vis versa. The general amount of pressure generated by the pressure field stimulation device is calibrated (factory-settings). Preferably, at its lowest setting, the pressure generated is of an amount great enough that most people would be able to feel on their body when the cup is applied, and at its highest setting, low enough such that it would not usually hurt a body part when applied. In embodiments, a user may modify the strength of the pressure field via user input to a user interface.

Figure 3B:
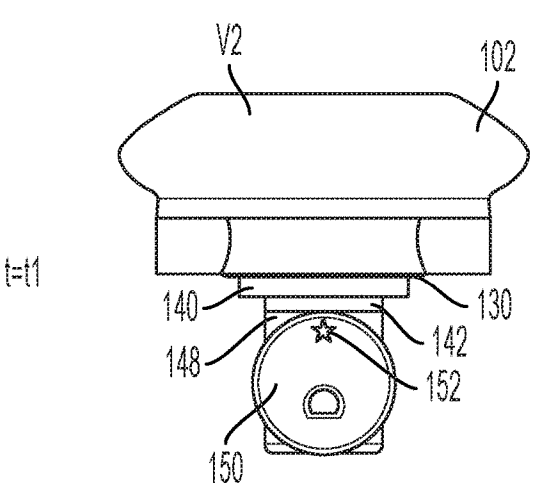
FIG. 3B shows an example motion sequence cycle for some embodiments of the present invention at t=t1.
Figure 3D:
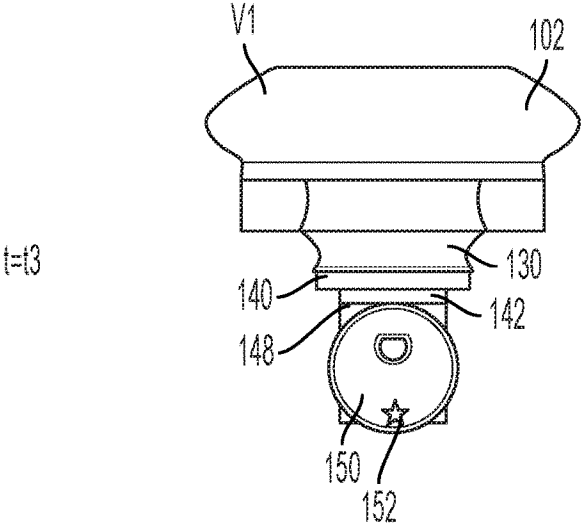
FIG. 3D shows an example motion sequence cycle for some embodiments of the present invention at t=t3.
Figure 3A:
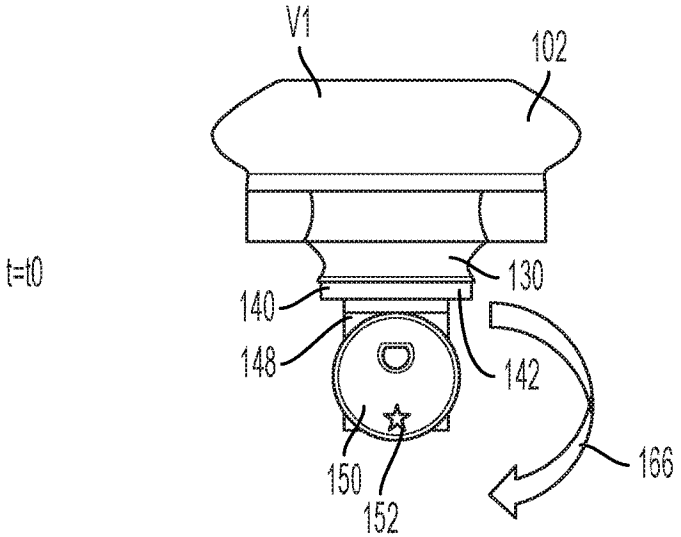
FIG. 3A shows an example motion sequence cycle for some embodiments of the present invention at t=t0.

FIGS. 3A-3D show an example motion sequence cycle for some embodiments of the present invention similar to the embodiment of FIGS. 2A-2D. FIG. 3A shows a starting position (before the cam begins to rotate) for the cam 150 at an initial time t=t0. As shown in FIG. 3A, the high point 152 of cam 150 is oriented away from the plate 140. The "high point" is the location of the cam farthest away from the point at which the cam is rotated by the motor shaft. Buckle region wall 130 is shown in a default position. The cavity of the cup 102 has a first volume (V1). In operation, the starting position shown in FIG. 3A represents a maximum volume Vmax for an operational cycle. Accordingly, V1=Vmax. In the example, the cam 150 rotates in a direction indicated by arrow 166. In some embodiments, the cam 150 may instead rotate in the opposite direction, the theory of operation is similar.

FIG. 3B, shows the cam 150 at an intermediate position at time t=t1. The cam 150 is rotated 180 degrees such that the high point 152 of cam 150 has pushed the rigid plate 140 such that it has caused the buckle region wall 130 of the cup 102 to buckle, or compress in the cavity (e.g., 106 of FIG. 1A), to a second volume (V2), which is a minimum volume Vmin.

Figure 3C:
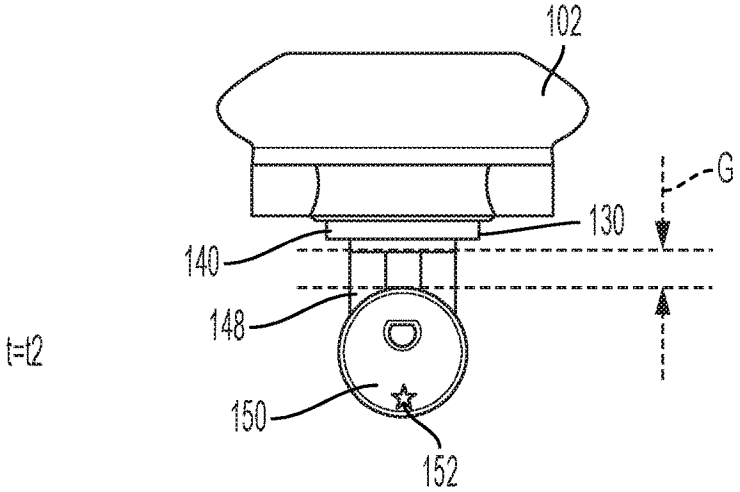
FIG. 3C shows an example motion sequence cycle for some embodiments of the present invention at t=t2

FIG. 3C, shows the cam 150 after a complete revolution of the cam 150 at time t=t2. The high point 152 has returned to the same position as it was in FIG. 3A. However, the rotation speed of the cam 150 is sufficiently fast such that the buckle portion 130 of cup 102 has not yet expanded to its default position, creating a gap G between the rigid plate 140 and the cam 150.

FIG. 3D shows the cup 102 at time t=t3, at which time the buckle region 130 has expanded back to the default position (also shown at FIG. 3A), moving the plate 140 towards the cam 150. Therefore, at the end of the operational cycle, the volume of the cavity returns to V1, which is Vmax. Therefore, the buckle region 130 is configured such that it will return from V2 to V1 in time for the next strike of the cam 150 to plate 140 (in some cases, against the cam strike 142).

In some embodiments, the cavity 106 of the cup 102 returns from the second volume (V2) to the first volume (V1), in between intermittent repetitions of the varying, as a result of the configuration of the cup 102 including buckle region wall 130. The buckle region wall 130 springs out from a compressed position to a default (expanded) position when force is removed therefrom. In some embodiments, returning of the cavity from the second volume to the first volume is achieved without a force external to the cup structure, such as electrical assistance or mechanical assistance from another article or device (e.g., the driver).

As the buckle region wall 130 of cup 102, expands or "springs out," the buckle region wall 130 causes a thud force, or a "thumping effect" throughout the cup, including the anchor walls 171. Such thud force is imparted to the labia of the user when the cup 102 is in contact with the labia, creating a pleasurable effect for the user. Such thud force is imparted to the skin/labia of the user when the cup 102 is in contact with the skin/labia, creating a pleasurable effect for the user. Thus, the thud force is a transfer of mechanical energy from the springing out of the buckle, which is imparted to the user through the cup. It may feel like a jolt to a user during use. Wings 118*a*-118*c* (e.g., FIG. 1A), if present, may assist with imparting the force to the skin/labia.

In some embodiments, the cam rotation is continuous. In other embodiments, the cam may stop at the position indicated by FIG. 3D for a predetermined amount of time before starting another rotation cycle. As an example, in some embodiments, the cam 150 may remain in the position indicated at FIG. 3D for a duration ranging from 200 milliseconds to 800 milliseconds, before starting another rotation cycle as indicated at 166 of FIG. 3A. These duration and speed values are exemplary, and other values are included within embodiments of the present invention.

During usage, a rim (e.g., 108 of FIG. 1) of the cavity (e.g., 106 of FIG. 1) is placed in contact with the skin surrounding the clitoral region (or other region of the body to be stimulated) to form a sealed, or substantially-sealed, chamber. The opening of the cavity is disposed over the clitoral region (or other region of the body to be stimulated). In the example of FIG. 3A, the cam is initially at its lowest position (turned to a point where that it provides minimum actuation so as to provide minimal or no compression of the cup), such that the initial volume of the cavity, V1, is Vmax. The initial pressure in the chamber is P1. When the stimulation device is powered on, the cam is rotated by the motor, causing the cam to make contact with the cam strike (or plate). This pushes the plate 140 to compress the cavity to a lower volume, indicated as V2, which in the example is Vmin. This increases the pressure inside the chamber to a maximum pressure indicated as P2. As the cam continues to rotate, and loses contact with the cam strike (or plate), the cavity returns to the non-compressed/maximum volume initial default position indicated as V1, releasing pressure in the chamber back to the minimum pressure value of P1.

In other words, the pressure starts at P1 (a reference pressure), which is a gauge pressure reading of zero, which is the difference between the absolute pressure and the atmospheric pressure. This is measured at the geographic location currently where the stimulation device is being used. In other words, the gauge reading of zero is the ambient air pressure, at the geographic location that the user is using the stimulation device, that exists at the time the user uses the device. In the example of FIGS. 3A-3D, as the cavity is compressed from V1 to V2, the pressure increases to P2 (the maximum pressure). As the buckle region wall 130 expands the cavity from V2 to V1, the pressure returns back to the starting pressure (P1). Since, in the example, the varied volume of the cavity is never greater than the initial volume (V1) at start time, no pressure below the reference pressure (start pressure) is generated in the chamber. The start time is when both the cup is in place on the user's body, forming a chamber, and the device is powered on. Accordingly, in this embodiment, only pressure at or above the reference pressure is generated. Such an embodiment is referred to as a "positive pressure" embodiment.

In such embodiments, the pressure field consists of pressure at or above a reference pressure. This varying pressure field stimulates a user's skin and/or clitoris by simulating a light touch similar to the way a person would stimulate themselves or another person by lightly touching them.

Figure 3F:
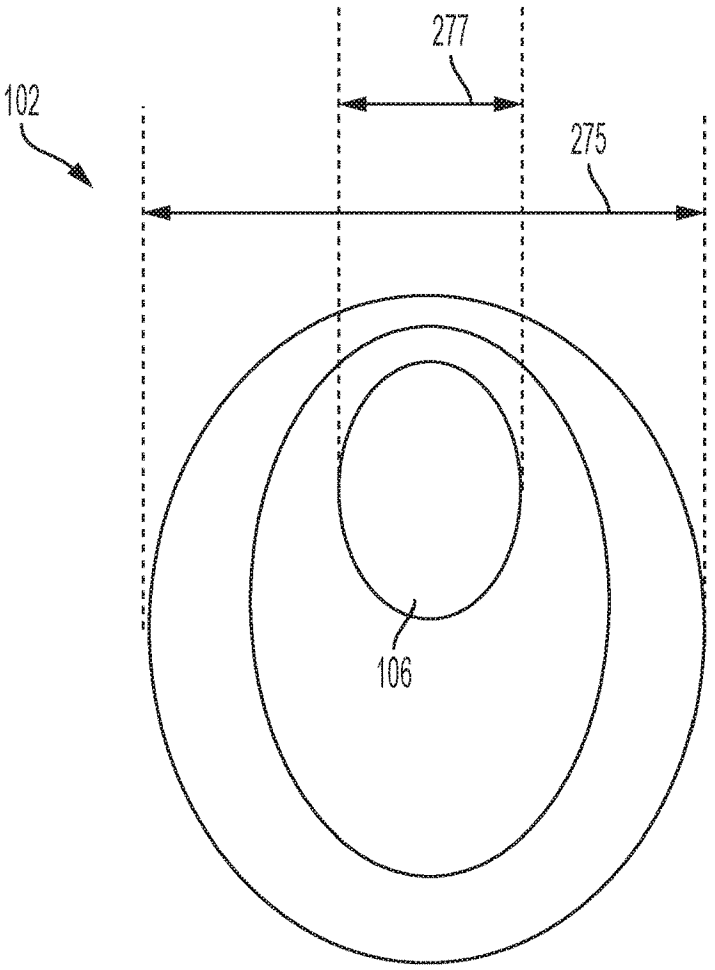
FIG. 3F is a top-down view of the cup as shown the compressed configuration of FIG. 3B.
Figure 3E:
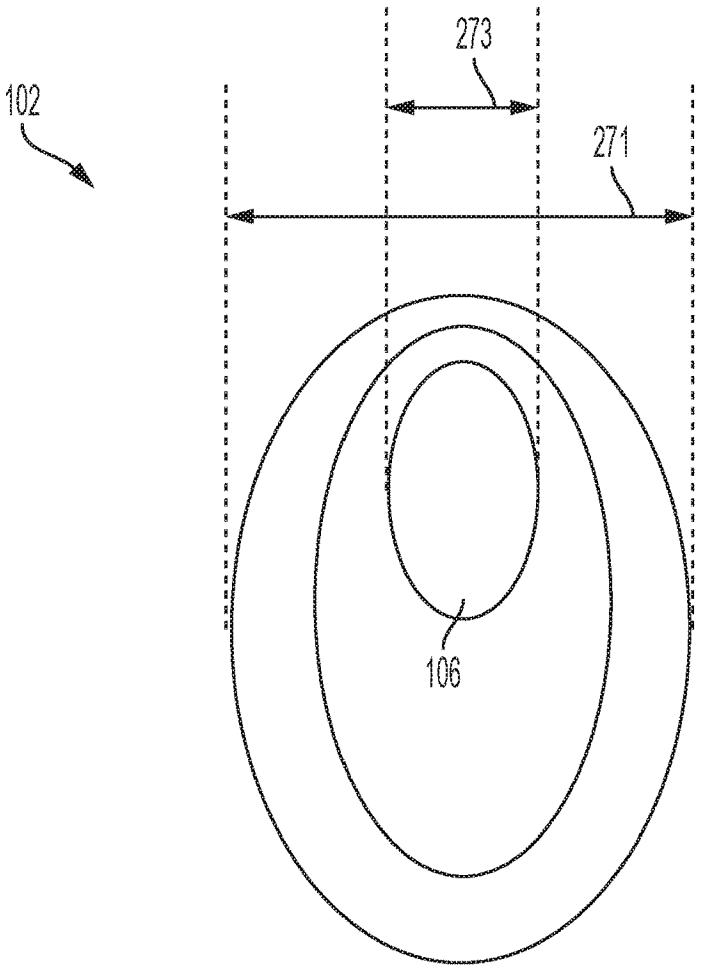
FIG. 3E is a top-down view of the cup as shown the uncompressed configuration of FIG. 3A.

FIGS. 3E-3F are top-down views that illustrate lateral expansion and contraction during the operation cycle illustrated in FIGS. 3A-3D. FIG. 3E corresponds to a top-down view of the cup 102 as shown the uncompressed configuration of FIG. 3A. In the uncompressed configuration, the cup 102 has an outer width 271, and a cavity width 273, corresponding to a width of cavity 106. FIG. 3F corresponds to a top-down view of the cup 102 as shown the compressed configuration of FIG. 3B. In the compressed configuration, the cup 102 has an outer width 275, and a cavity width 277, corresponding to a width of cavity 106. The compressed configuration widths are greater than the corresponding uncompressed configuration widths. Thus, width 275 is greater than width 271. Similarly, width 277 is greater than width 273. In some embodiments, for the uncompressed configuration, width 271 is 42 millimeters and width 273 is 10 millimeters. In those embodiments, for the compressed configuration, width 275 is 43 millimeters and width 277 is 11.5 millimeters. In some embodiments, the widths of the compressed configuration are between 3 to 15 percent greater than corresponding widths of the uncompressed configurations. In embodiments, a width of the cavity of the cup increases from a first width to a second width, during a transition from the second volume back to the initial volume, as depicted in the cycle of FIGS. 3A-3D. This expansion and contractions serves to mimic behavior of a human mouth engaged in oral sex with a vagina, serving to enhance the pleasure of the user during use of the device.

Figure 4:
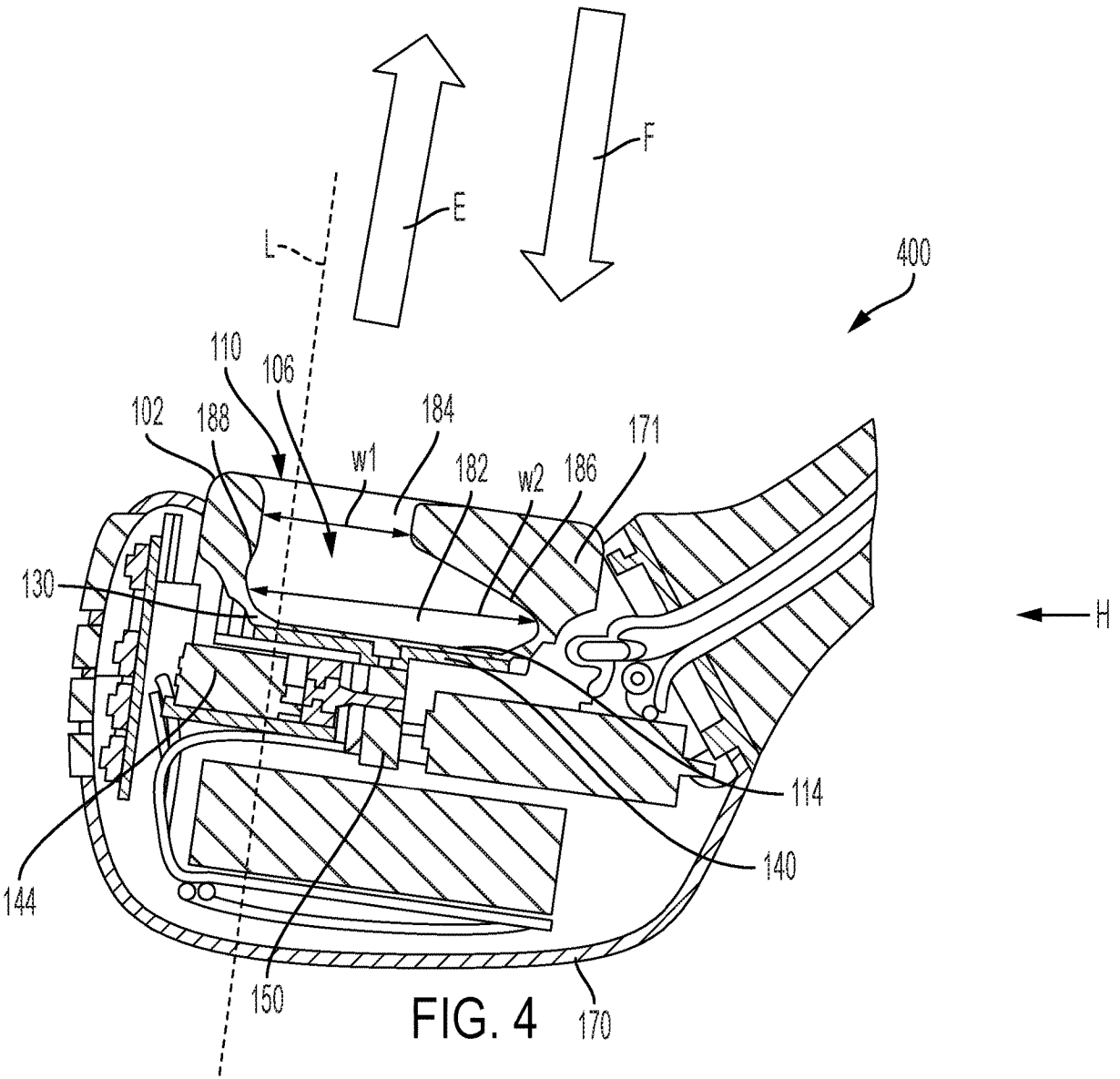
FIG. 4 shows a cross-section of an embodiment of the invention including a cup and a driver installed into a housing.

FIG. 4 shows a cross-section of an embodiment 400 of the invention including a cup and a driver installed into a housing. The cup 102 is, disposed on a housing 170. In some embodiments, housing 170 is made from plastic, metal, or other suitable (preferably non-porous) rigid material. In some embodiments, cup 102 is molded into a sheath including a layer of silicone, TPE, or other suitable material, disposed on the housing 170. In some embodiments, the cup is adhered to otherwise attached directly to the housing 170 without molding into a sheath. The components of the driver are disposed within the housing 170. The driver includes a motor 144, plate 140, and cam 150. During operation, the motor 144, mechanically coupled to cam 150, rotates the cam 150. When the cam 150 is in contact with plate 140, the cam 150 pushes plate 140 to compress the buckle region wall 130 of cup 102 in the direction indicated by arrow E, reducing the volume of the cavity 106 from V1 to V2. This increases the pressure in a chamber formed by the cavity 106 and skin of a user when the device is in use. When the cam 150 is not in contact with plate 140, the buckle region wall 130 of cup 102 expands back to V1 in the direction indicated by arrow F.

In the embodiment of FIG. 4, to increase the amount of air compression/pressure near the user's body, the cavity 106 comprises a first width W1 and a second width W2 where W1 is not equal to W2. In the example shown, W1, closer to the opening 110, is smaller than (<) W2, closer to the base 114. In some embodiments, W2 may be smaller than W1. Additionally, in some embodiments, the cross section of cavity 106 may be asymmetrical. For example, edge 186 of the lateral cavity wall has a dissimilar contour as compared to edge 188 of the lateral cavity wall. Thus, in some embodiments, the cavity 106 comprises an asymmetrical cross-section. In operation, as the base 114 of the cavity 106 is pushed by the plate 140, air is compressed from the wider, lower portion 182 into the more narrow, upper portion 184, resulting in an increase in air compression/pressure in the chamber (formed by the cavity and user's skin), providing a pleasurable sensation for the user.

Figure 5A:
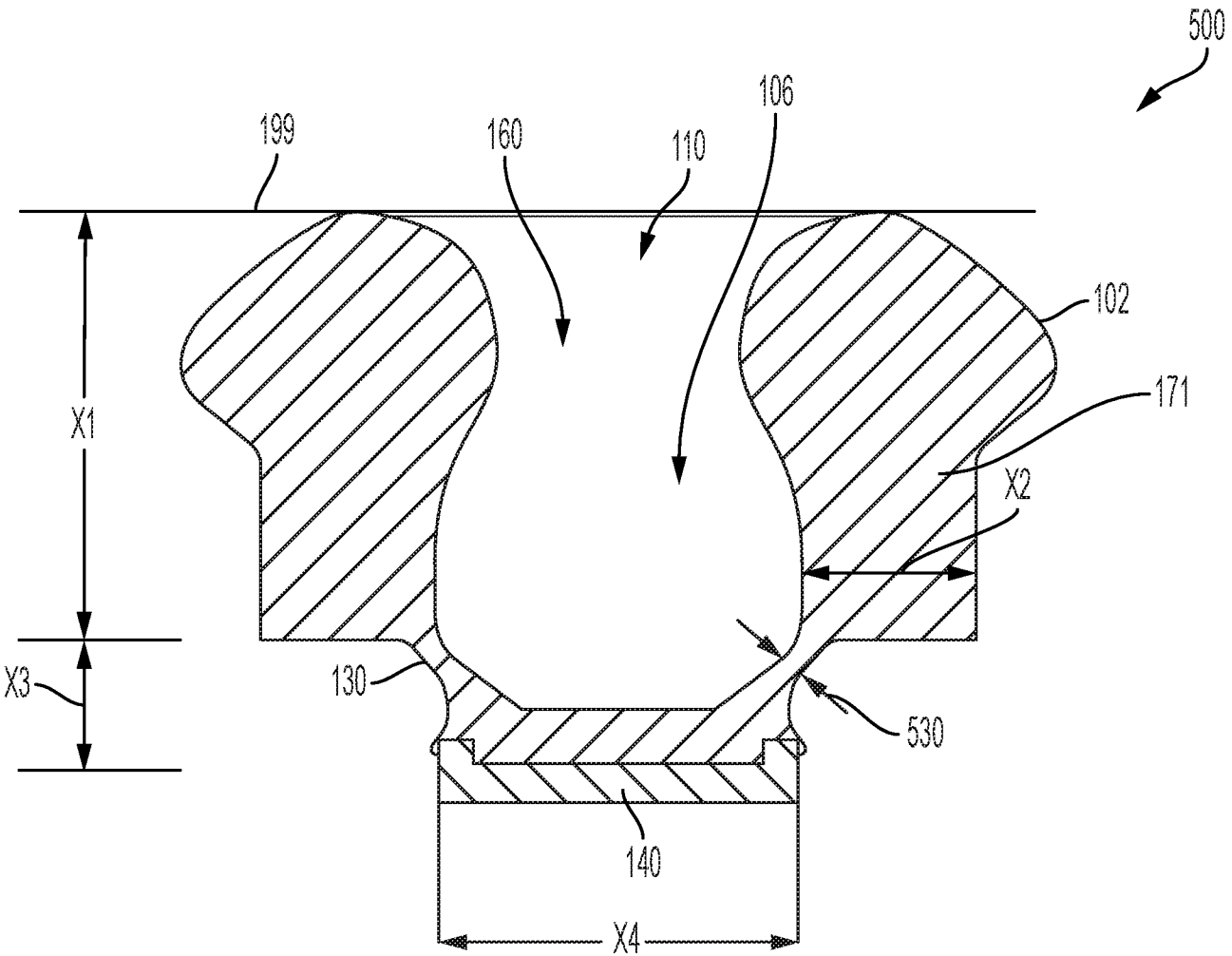
FIG. 5A shows a cross-section diagram of a cup and plate assembly in default position against skin of a user.

FIG. 5A shows a cross-section diagram (cut along line H of FIG. 4 viewed from direction indicated by arrow H of FIG. 4) of a cup and plate assembly 500 in default position against skin of a user. Buckle region wall 130 is shown in default position. Anchor wall 171 is in view. The material of the buckle region wall is "relaxed". In use, the user places the opening 110 of the cup 102 onto their skin 199. The skin 199 seals or substantially seals a cavity 106 to form a chamber 160.

Figure 5B:
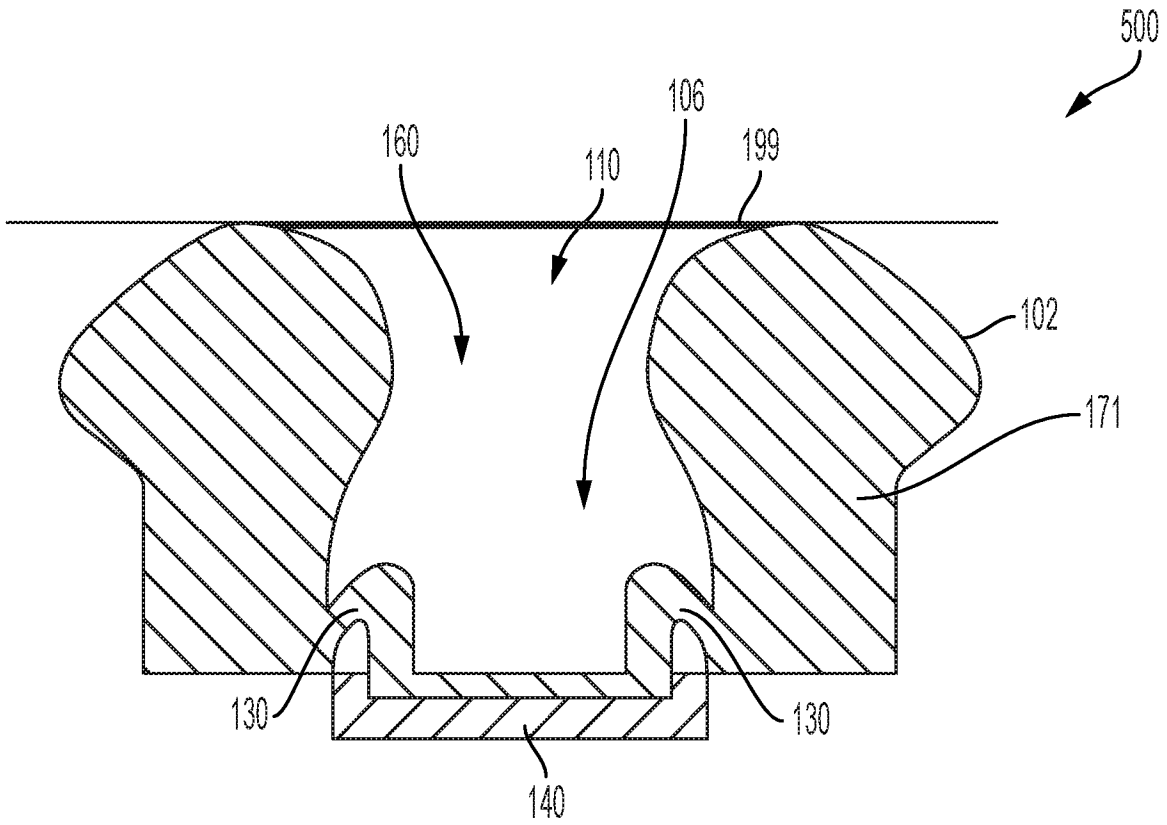
FIG. 5B shows a cross-section diagram of a cup and plate assembly of FIG. 5A in compressed position against skin of a user.

FIG. 5B shows a cross-section diagram of a cup and plate assembly 500 of FIG. 5A in compressed position against skin 199 of a user. As shown, buckle region wall 130 is compressed due to pushing force placed on it by the cam (e.g., FIGS. 3A-3D) through plate 140. Accordingly, the volume of the cavity 106 in FIG. 5B is different from the volume of the cavity 106 in FIG. 5A. Note that anchor wall 171 may buckle, or bend, in addition to the buckle region wall 130, in some embodiments. In such though, the buckle region wall 130 will buckle first.

As the stimulation device continues to operate from the compressed position shown in FIG. 5B, the buckle region 130 expands out to the default position (FIG. 5A) once the pushing force of the cam 150 is removed. In some embodiments, this expansion occurs without electrical assistance or mechanical assistance from a device external to the cup structure (meaning the material and the configuration of the cup). The cavity expands in volume during the time of non-contact of the cam 150 to the rigid plate 140. Accordingly, during the operational cycle, the volume of the cavity is cyclically varied to create a pressure field in the chamber during use.

The following configuration of the cup is optimal for expansion from compressed position to default position to create the thud force, without a force external to the cup structure. In embodiments, dimension X1 (height of the cup) ranges from 16 millimeters to 20 millimeters. In embodiments, dimension X2 (anchor wall 171) ranges from 6 millimeters to 10 millimeters. In embodiments, the buckle depth X3 ranges from 4 millimeters to 20 millimeters. In embodiments, the buckle width X4 ranges from 20 millimeters to 30 millimeters. In embodiments the minimum thickness 530 of the buckle region wall 192 ranges from 1 millimeter to 4 millimeters. In some embodiments the ratio of the buckle region minimum thickness 530 to the buckle depth ranges from 0.05 to 1.00. In some embodiments, the buckle region wall material has a Shore durometer value ranging from A5 to D30. In some embodiments, the Shore durometer is D30. Although these values are optimal, any suitable values for the variables described herein are included within the scope of the invention that can achieve the result described herein.

In some embodiments, the speed of the rotation of the cam is 10 to 5000 rpm. In some embodiments, the speed ranges from 300 rpm to 600 rpm. In some embodiments, the speed of the cam rotation is a setting that is user-adjustable, allowing the user to customize the operation of the stimulation device for their preference. The user can choose a higher speed for an increased frequency of pressure changes (and vis versa), and also control the frequency of the resulting cyclical thud forces.

Note that in some embodiments, the cup may be configured differently, and therefore, return to V1 only due to the resilient nature of the cup material. In such cases, the return may be at a slower acceleration than when a cup with a configuration as shown herein is used. The slower acceleration will result in loss of the thud effect, and instead be a more "smooth" return.

Figure 6A:
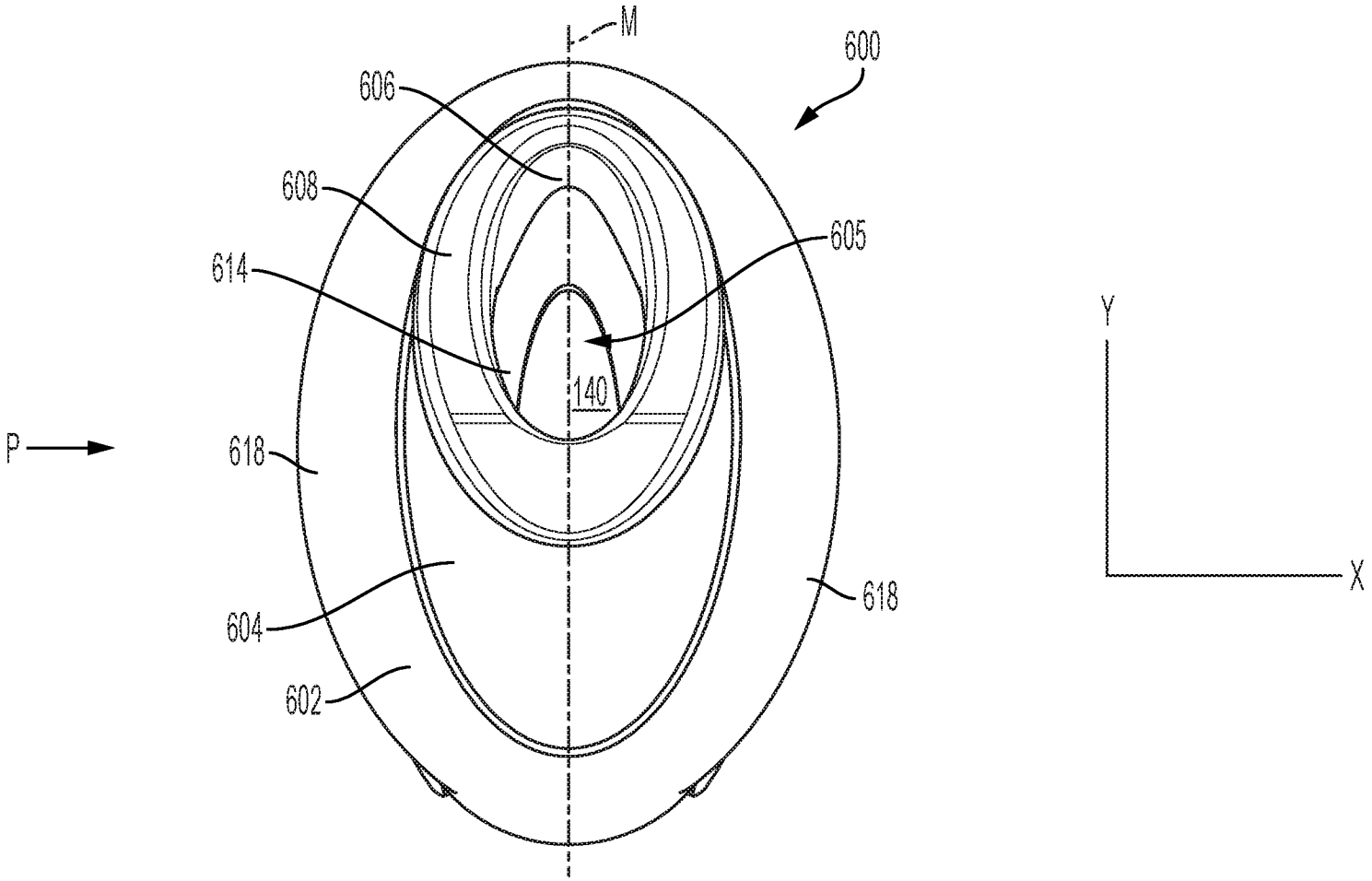
FIG. 6A shows a top-down view of an additional embodiment of cup and plate assembly.
Figure 6B:
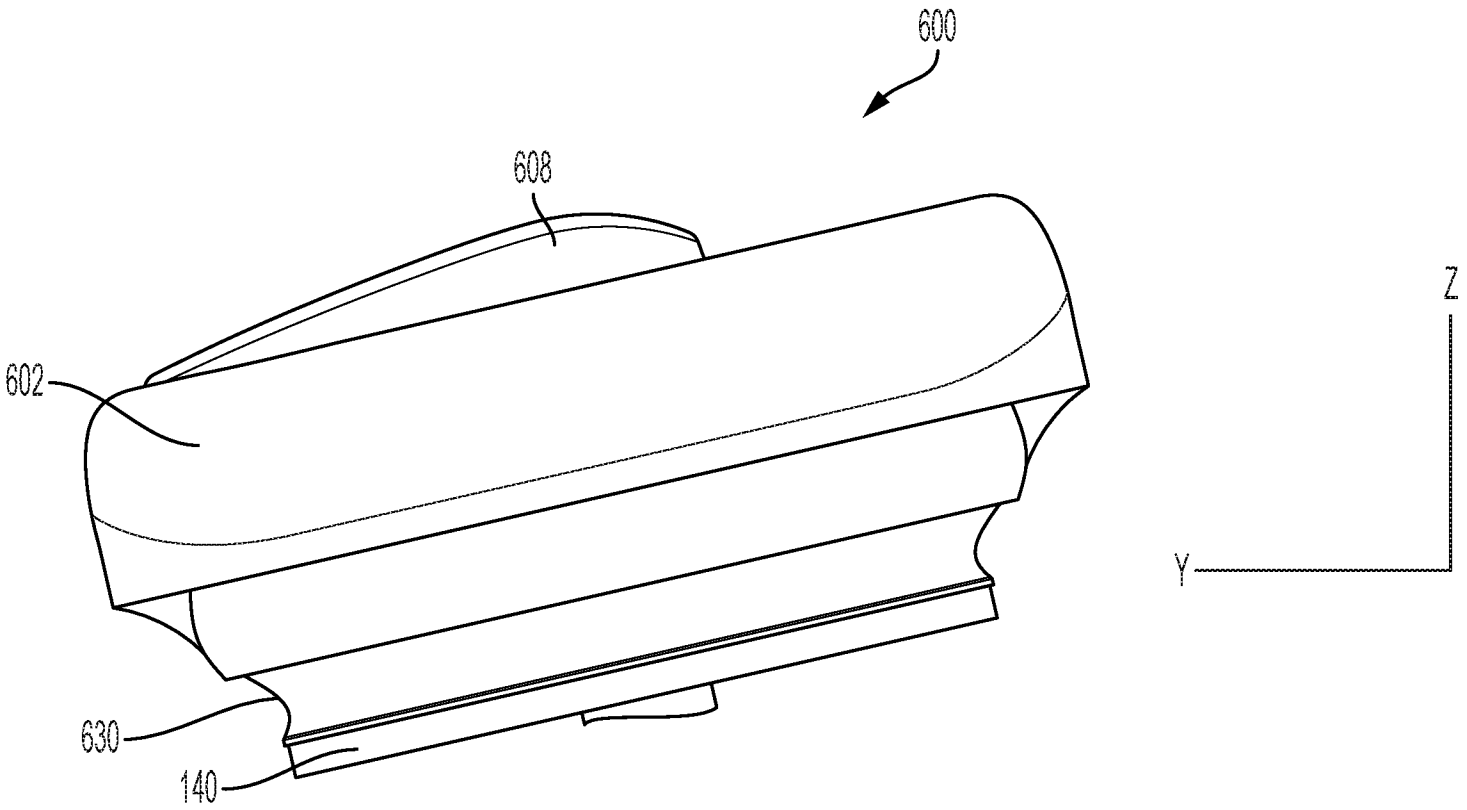
FIG. 6B shows a side view of the additional embodiment of cup and plate assembly of FIG. 6A.
Figure 6C:
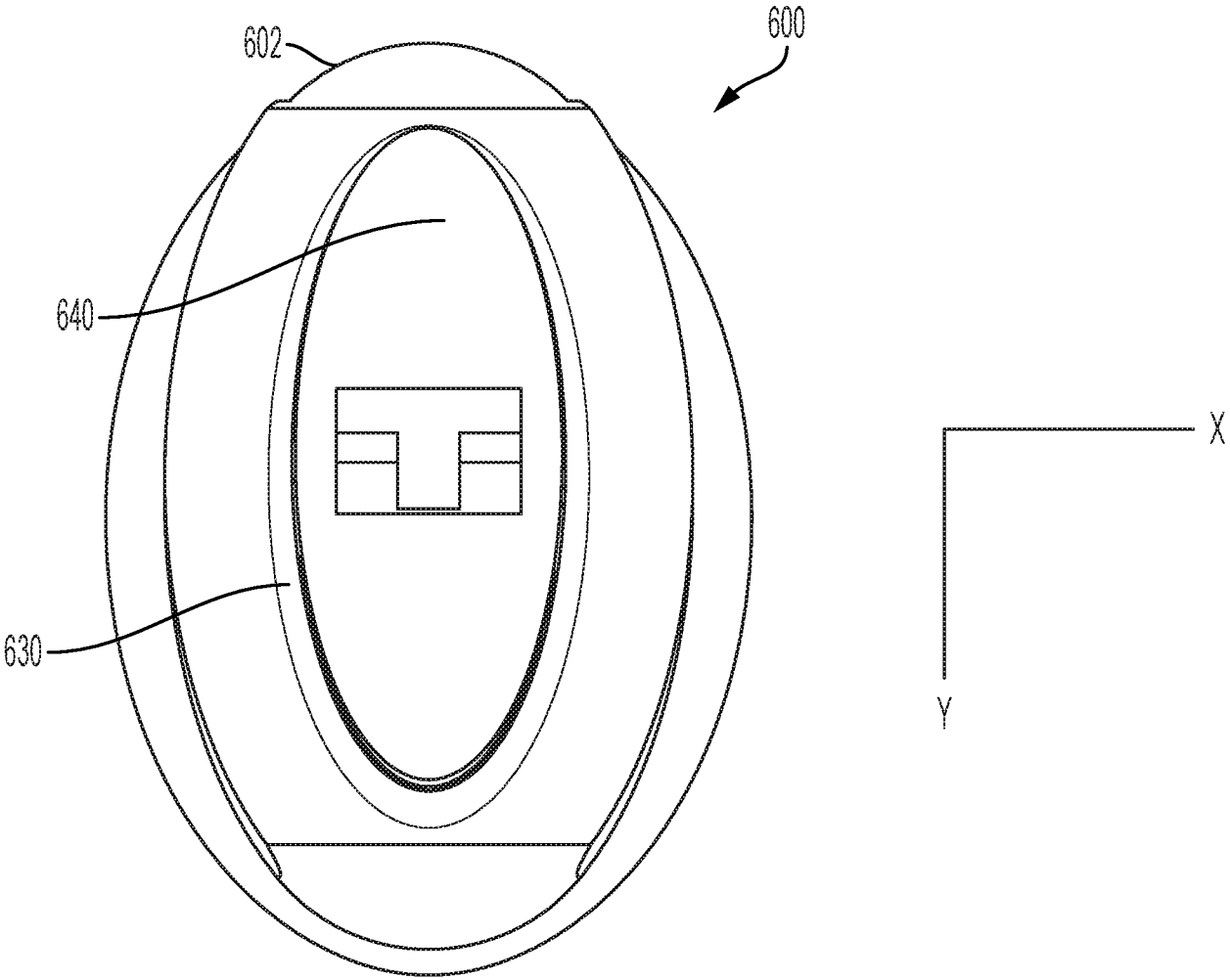
FIG. 6C shows a bottom-up view of the additional embodiment of cup and plate assembly of FIG. 6A.
Figure 6D:
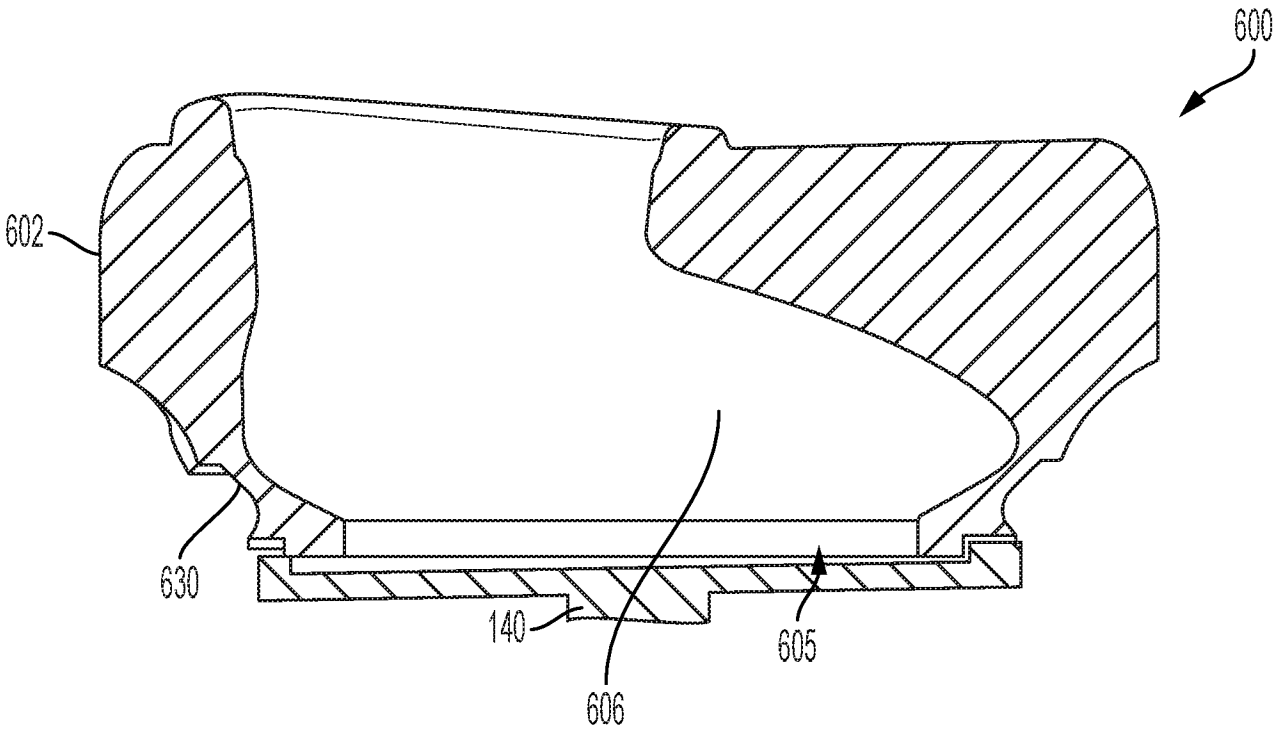
FIG. 6D shows a cross-section view of the additional embodiment of cup and plate assembly of FIG. 6A.

FIGS. 6A-6D show views of an additional embodiment of cup and plate assembly 600. FIG. 6A shows a top-down view of cup 602. Cup 602 is substantially similar to cup 102 except that it has a discontinuous base, i.e. an opening 605 in the base 614 of the material of the cup 602 (sealed via attached plate 140). In FIG. 6A, plate 140 can be seen through the opening 605. In some embodiments, cup 602 may also include basin 604, and the cavity is disposed within basin 604. In some embodiments, cup 602 may include wings portion denoted generally here as 618. In some embodiments, a rim 608 of the cavity 606 is a raised lip. FIG. 6B shows a side view of cup 602 with plate 140 installed thereon. Buckle region wall 630 is in view. The side opposite the side shown looks symmetrical. FIG. 6C is a bottom-up view of cup 602 with plate 140 installed thereon. FIG. 6D is a cross-section view (cut along line M shown in FIG. 6A viewed from direction denoted by arrow P) of cup 602 with plate 140 installed thereon. Cavity 606 and base opening 605 are in view. Further driver components may be implemented as described herein. Cup 602 has a buckle region wall 630, which compresses and uncompresses (i.e. expands) during usage resulting in a variable volume of the cavity 606 of cup 602 during operation of a stimulation device.

Figure 7C:
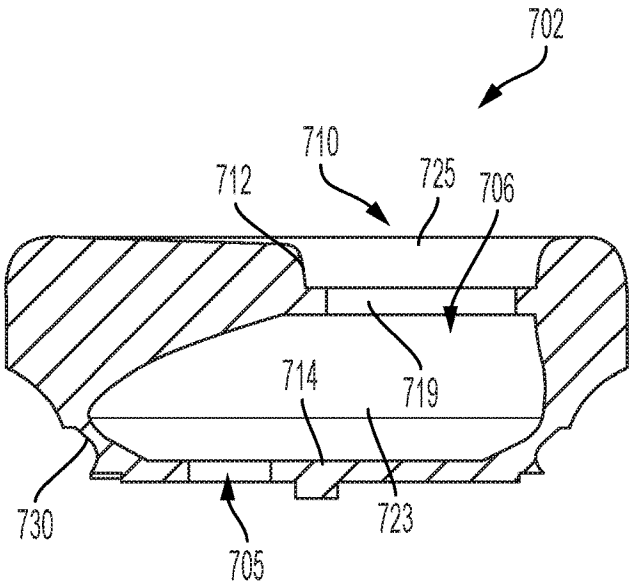
FIG. 7C is a cross-section view of the cup of FIG. 7A.
Figure 7B:
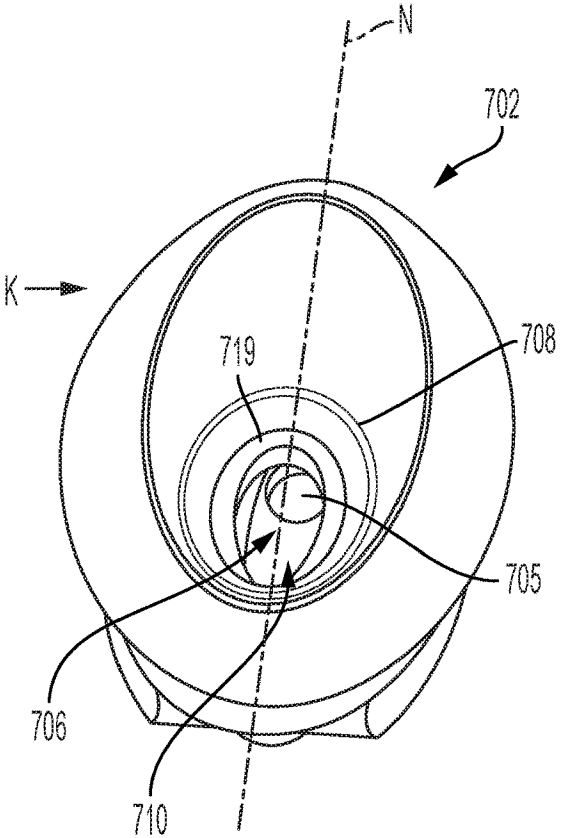
FIG. 7B shows a top-down perspective view of the cup of FIG. 7A.
Figure 7A:
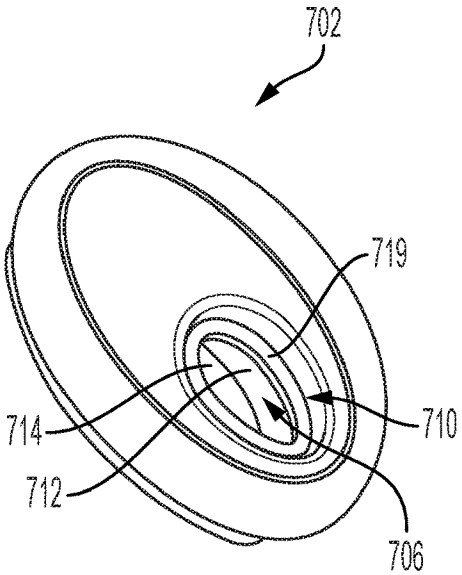
FIG. 7A shows a tipped side perspective view of a cup 702 in accordance with some embodiments of the invention.
Figure 7E:
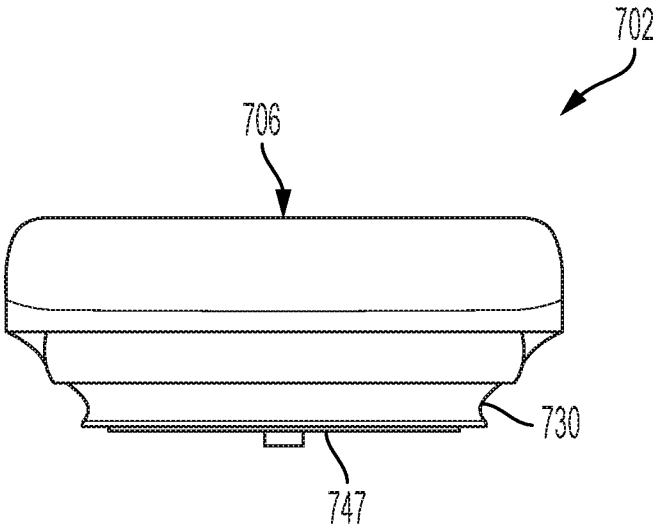
FIG. 7E is a side view of the cup of FIG. 7A.
Figure 7D:
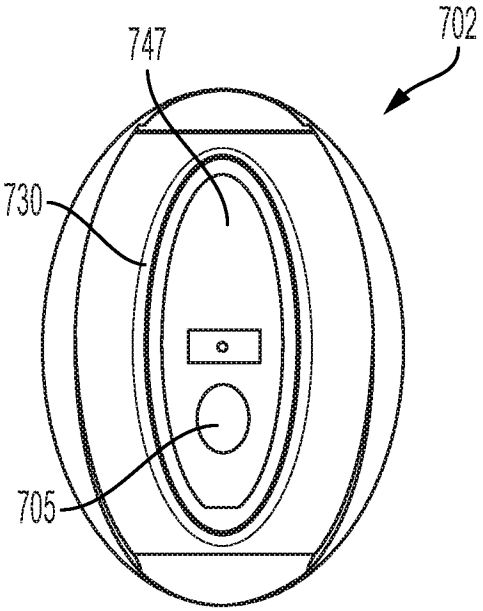
FIG. 7D is a bottom-up view of the cup of FIG. 7A.

FIGS. 7A-7E show view of an additional embodiment of a cup in accordance with some embodiments of the invention. FIG. 7A shows a tipped side perspective view of cup 702. FIG. 7B shows a top-down perspective view of cup 702. FIG. 7C is a cross-section view (cut along line N in FIG. 7B viewed from direction denoted by arrow K) of cup 702. FIG. 7D is a bottom-up view of cup 702. FIG. 7E is a side view of cup 702 (cup 702 from the opposite side is symmetrical). Cup 702 is substantially similar to cup 602, except the cavity 706 has a flange 719 splitting the cavity into two compartments (i.e. sections)—a first compartment 723 and a second compartment 725. The two sections are separated by a flange 719. Flange 719 is a protrusion that extends around the circumference of the interior lateral wall 712 of the cavity 706. In some embodiments, it is integral with and formed of a continuous material with the lateral wall. In some embodiments, the flange and the lateral wall consist of a single material. Cavity 706 has a rim 708 defining an opening 710 of the cavity. Cavity 706 is defined by an interior lateral wall 712 and a base 714 (bottom in the orientation shown). In some embodiments, the cup 702 has a discontinuous base, i.e. an opening 705 in the base of the material of the cup 702. The cup has an underside 747. Cup 702 has a buckle region wall 730, which compresses and uncompresses (i.e. expands) during usage resulting in a variable volume of the cavity 706 of cup 702 during operation of a stimulation device.

Figure 8B:
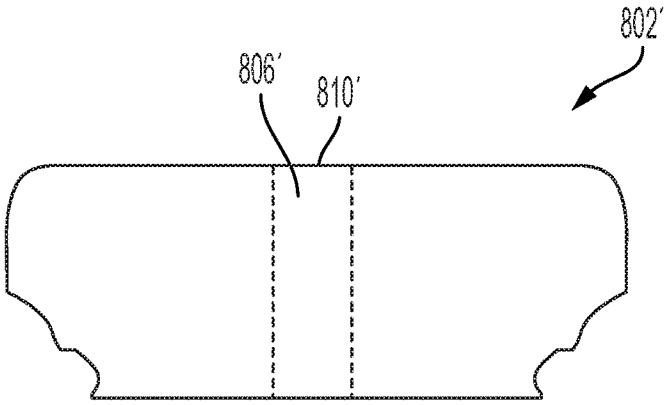
FIG. 8B shows an example of a side cross-section view of a round cup.
Figure 8A:
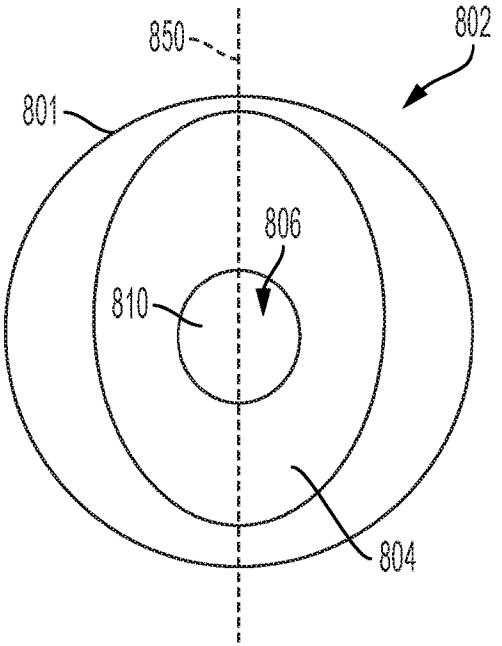
FIG. 8A shows a top-down view of an additional embodiment of a cup.
Figure 8C:
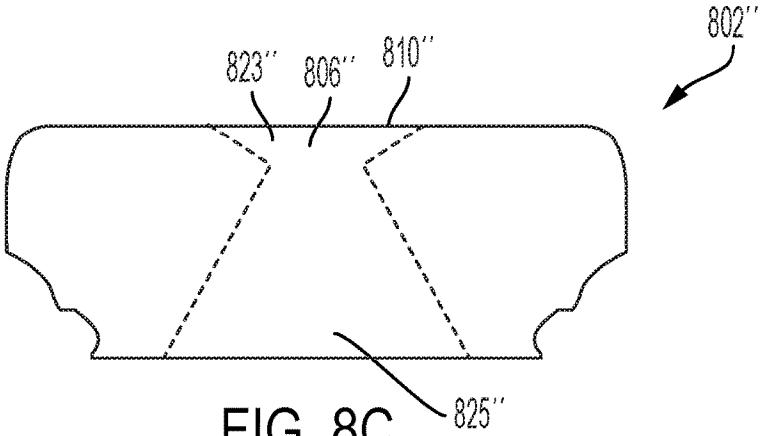
FIG. 8C shows an example of a side cross-section view of a round cup.

FIG. 8A shows a top-down view of an additional embodiment of a round cup 802. In some embodiments, the cup is round in terms of outer perimeter 801, and has an opening 810 to a cavity 806, as shown in FIG. 8A. As shown, in some embodiments, the cavity 806 is formed in the center of the cup 802. In some other embodiments, the cavity is disposed off-center. In some embodiments, there is also included basin 804. FIG. 8B shows an example of a side cross-section view of the round cup 802', substantially similar to cup 802, where the cut is along line 850 of FIG. 8A. In this example, the lateral wall of cavity 806' is round and cavity 806' has an opening 610'. The cavity is formed as a single section. FIG. 8C shows an example of a side cross-section view of the round cup 800" substantially similar to cup 802, where the cut is along line 850 of FIG. 8A. In this example, the lateral wall of cavity 806" is an inverted funnel shape, creating two compartments, 823" and 825". Cavity 806" has an opening 810". In embodiments, the cup may be any suitable shape.

Figure 9C:
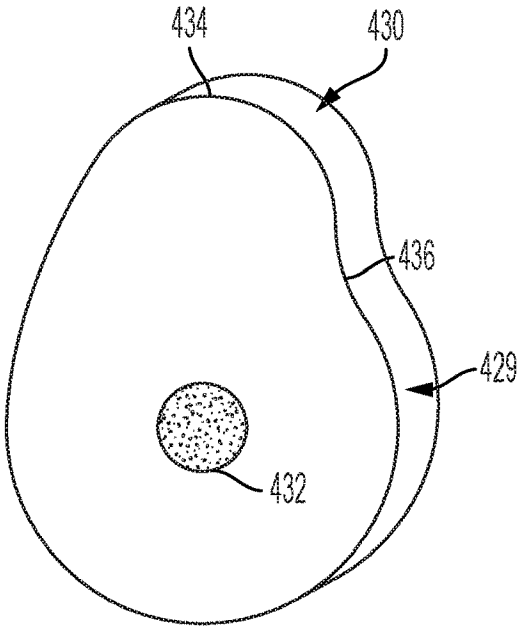
FIG. 9C shows an example of yet another cam in accordance with some embodiments of the present invention.
Figure 9B:
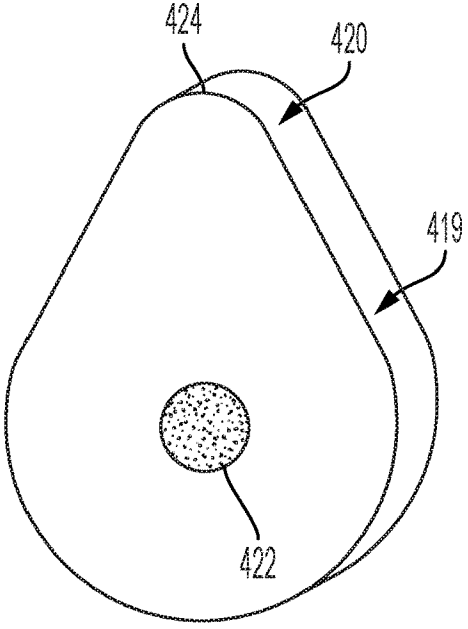
FIG. 9B shows an example of another cam in accordance with some embodiments of the present invention.
Figure 9A:
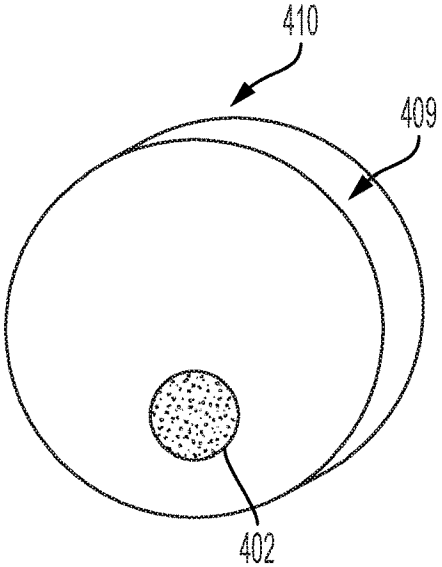
FIG. 9A shows an example of a cam in accordance with some embodiments of the present invention.

FIGS. 9A-9G show examples of cams for embodiments of the present invention. In some embodiments, the cam is substantially round or ovular. In FIG. 9A, the cam 410 is an eccentrically mounted round cam, similar to as shown in FIGS. 3A-3D. The center of rotation for the cam 410 is indicated as 402. The center of rotation is the location on the cam where the cam is mounted to the shaft of the motor. The lateral wall 409 of the cam 410 is circular. FIG. 9B shows a cam 420 that is a lobed symmetrical cam. Cam 420 has lobe 424, and center of rotation 422. Accordingly, its lateral wall 429 is lobular in shape. FIG. 9C shows a cam 430 that is a lobed asymmetrical cam. Cam 430 has lobe 434 and center of rotation 432. Cam 430 also has an indentation 436. Accordingly, its lateral wall 429 is irregular in shape.

Figure 9E:
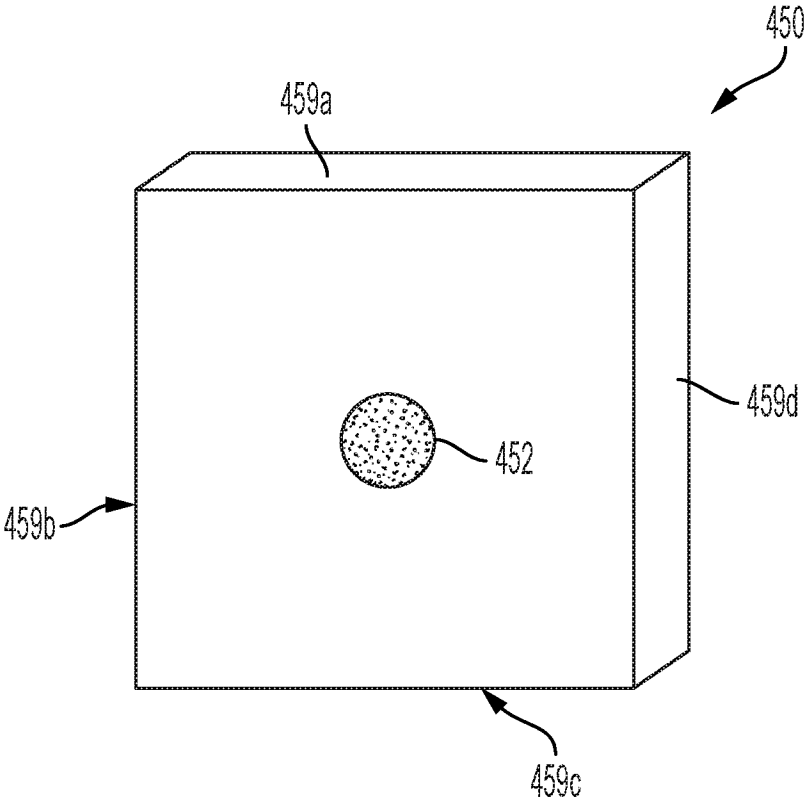
FIG. 9E shows an example of another cam in accordance with some embodiments of the present invention.
Figure 9D:
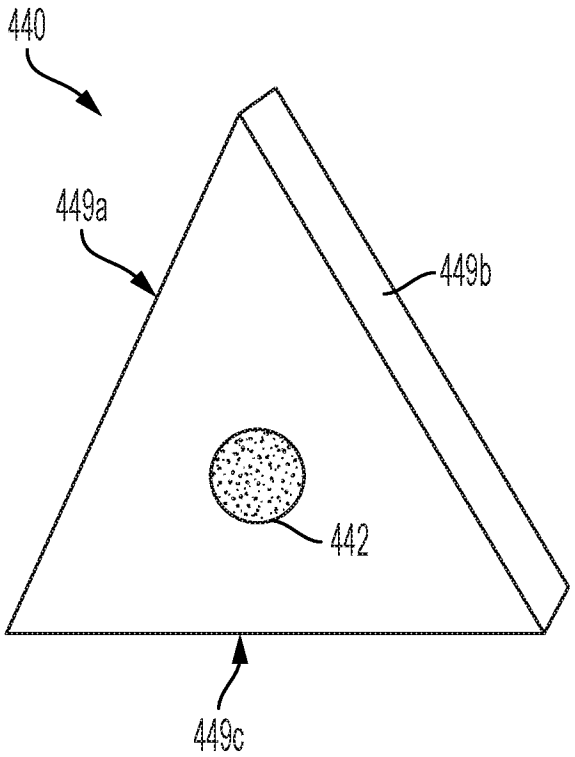
FIG. 9D shows an example of another cam in accordance with some embodiments of the present invention.

In some embodiments, the cam is a polygon as shown in FIGS. 9D and 9E. FIG. 9D shows a cam 440 that is a triangle cam. Cam 440 has three straight lateral sides 449*a*, 449*b*, 449*c* that, in operation, intermittently contact the cam strike. The center of rotation for the cam is indicated as 442. FIG. 9E shows a cam 450 that is a square cam. Cam 450 has four straight lateral sides 459*a*, 459*b*, 459*c*, and 459*d* that, in operation, intermittently contact the cam strike. The center of rotation for the cam is indicated as 452.

Figure 9G:
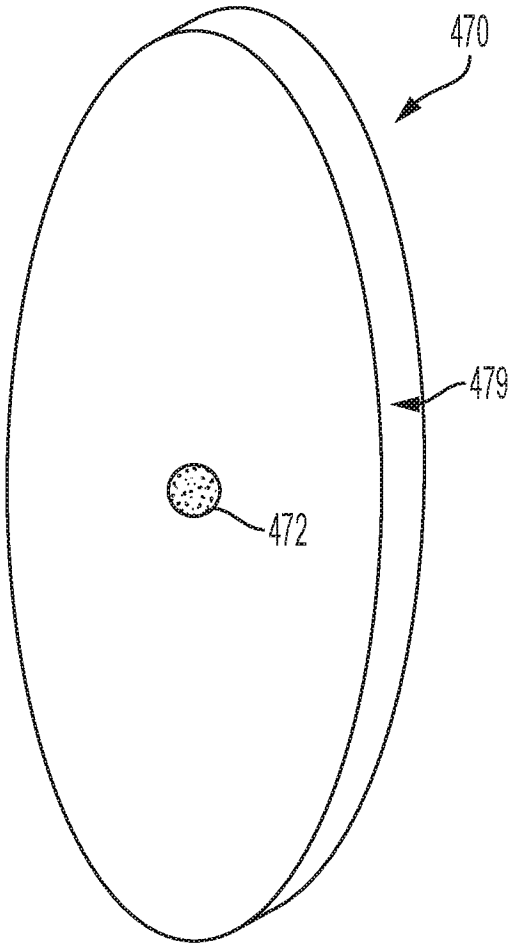
FIG. 9G shows an example of a cam in accordance with some embodiments of the present invention.
Figure 9F:
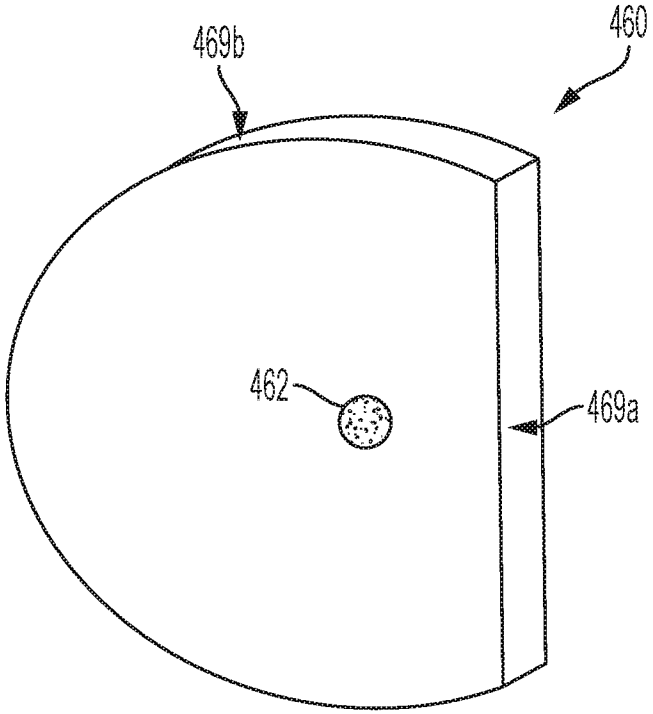
FIG. 9F shows an example of another cam in accordance with some embodiments of the present invention.

FIGS. 9F-9G show additional cams in accordance with embodiments of the present invention. Referring now to FIG. 9F, cam 460 is a "D-shaped" cam having flat side lateral wall 469*a*, and rounded side 469*b*. The center of rotation for the cam is indicated as 462. Referring now to FIG. 9G, cam 470 is an oval-shaped cam, having an ovular lateral side 479. The center of rotation for the cam 470 is indicated as 472.

The cam shapes shown in FIGS. 9A-9G are exemplary, and other suitable cam shapes are included within the scope of embodiments of the present invention. As the cam rotates around its center of rotation, its lateral wall(s) makes intermittent contact with a plate (e.g., 140 of FIGS. 3A-3D) directly, or with the cam strike (e.g., 142 of FIGS. 3A-3D) of a plate (e.g. 140 of FIGS. 3A-3D).

Figure 10B:
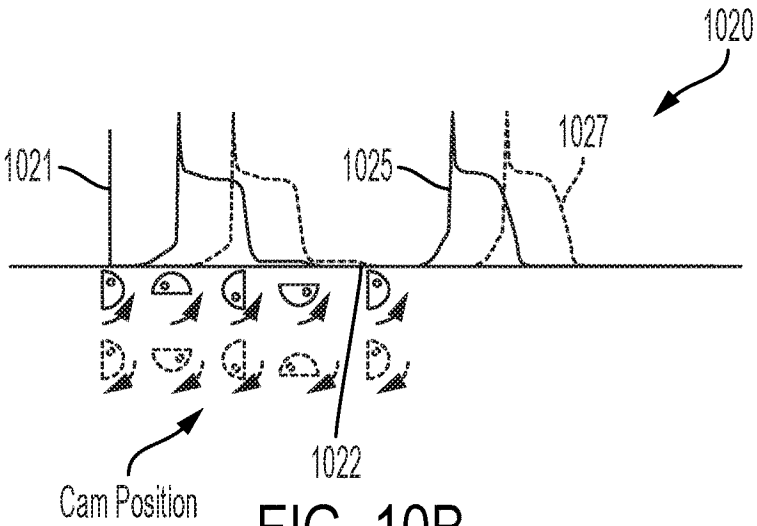
FIG. 10B shows a time pressure graph for an embodiment using a D-shaped cam.
Figure 10A:
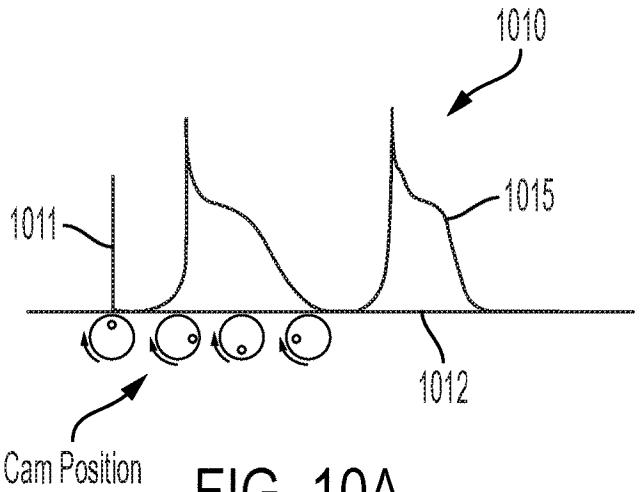
FIG. 10A shows a time-pressure graph for an embodiment using a round or oval cam.
Figure 10C:
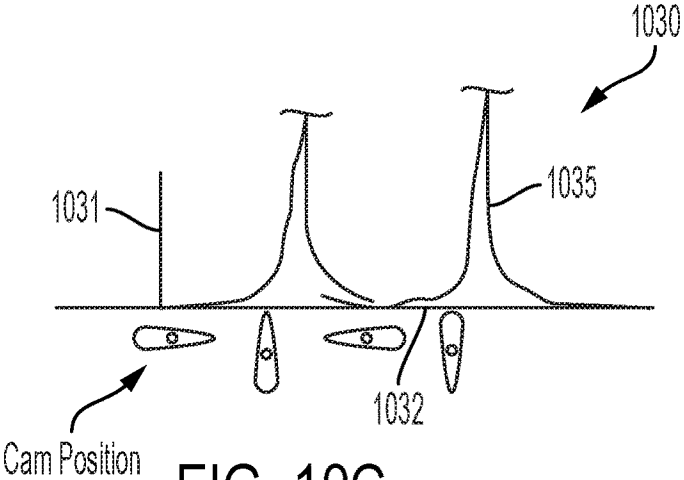
FIG. 10C shows a time pressure graph for an embodiment using an oval-shaped cam.

FIG. 10A-10C show time-pressure graphs for various cams in example positive pressure embodiments of the present invention. FIG. 10A is a time-pressure graph 1010 showing the time-pressure relationship of the cam 410 of FIG. 9A where buckle wall region 130 is in default position at time TO. Graph 1010 comprises vertical axis 1011 representing pressure, and horizontal axis 1012 representing time. Zero on the vertical axis indicates gauge pressure at atmosphere. Zero on the horizontal axis represents TO. This is the ambient air pressure, at the geographic location that the user is using the stimulation device, that exists at the time the user uses the device. As the cam 410 rotates, a time-pressure curve 1015 is generated, indicating varying amounts of pressure that occur within the chamber during operation.

FIG. 10B is a time-pressure graph 1020 showing the time-pressure relationship of the cam 460 of FIG. 9F where buckle wall region 130 is in default position at TO. Graph 1010 comprises vertical axis 1021 representing pressure, and horizontal axis 1022 representing time. Zero on the vertical axis indicates gauge pressure at atmosphere. Zero on the horizontal axis represents time TO. As the cam rotates, a first time-pressure curve 1025 is generated, indicating varying amounts of pressure that occur within the chamber during operation with counter-clockwise rotation of the cam 460. If the cam 460 is operated in a clockwise rotation, then a second time-pressure curve 1027 is instead generated, indicating varying amounts of pressure that occurs within the chamber during operation with clockwise rotation of the cam 460.

FIG. 10C is a time-pressure graph 1030 showing the time-pressure relationship of the cam 470 of FIG. 9G where buckle region 130 is in default position at time TO. Graph 1030 comprises vertical axis 1031 representing pressure, and horizontal axis 1032 representing time. Zero on the vertical axis indicates gauge pressure at atmosphere. Zero on the horizontal axis represents TO. As the cam 470 rotates, a time-pressure curve 1035 is generated, indicating varying amounts of pressure that occur within the chamber during operation.

Figure 11A:
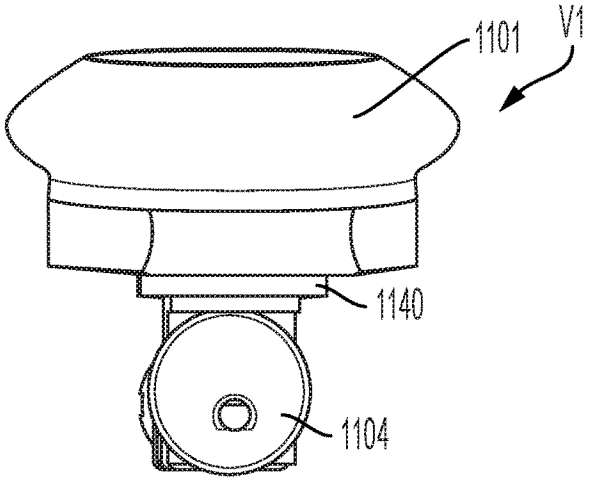
FIG. 11A shows an embodiment of the present invention, in accordance with another cycle, where the volume of the cup is at V1.
Figure 11B:
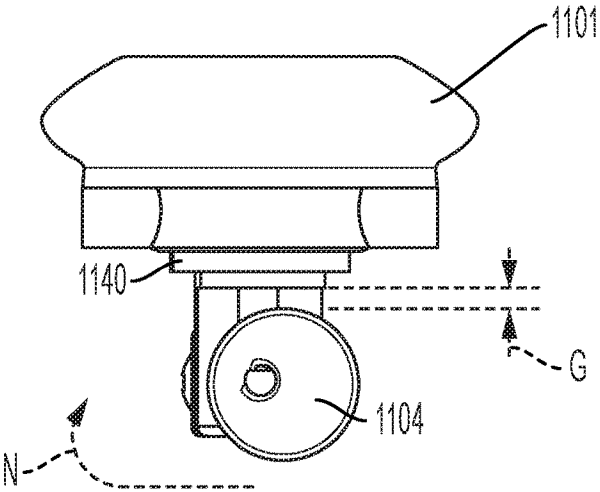
FIG. 11B shows the embodiment of FIG. 11A where the cam has rotated.
Figure 11C:
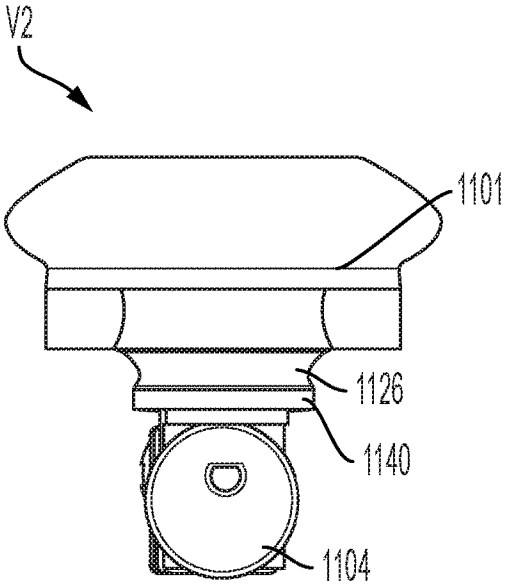
FIG. 11C shows the embodiment of FIG. 11B where the volume of the cup is V2.

FIGS. 11A-11C show another cycle for embodiments of the present invention. Cup 1101 is substantially similar to cup 102 or cup 702, made of a resilient material and having a rim and a cavity. Buckle region wall 1126 is substantially similar to buckle region wall 130. The components of the driver are substantially similar to driver assembly 239. Although the cam 1104 and the plate 1140 intermittently make contact with one another, they are not permanently connected to one another In these embodiments, the starting position at time t0 of the cup 1101 is as shown in FIG. 11A, where cam 1104 is in its highest position with buckle region wall 1126 in compressed position. Accordingly, in this example, V1 of the cavity of the cup 1101 is Vmin (or minimum volume) having a pressure equal to gauge pressure. During use, the rim of the cavity of cup 1101 is pressed against the clitoral region (or other region to be stimulated) of a user, creating a sealed or substantially sealed chamber. At a later time t1, the cup 1101 is in a position as shown in FIG. 11B. In FIG. 11B, the cam 1104 has rotated in the direction indicated by arrow N, such that the cam 1104 has rotated approximately 100 to 120 degrees from the starting position depicted in FIG. 11A. When the cam 1104 is rotated fast enough such that it moves away from the plate 1140 faster than the buckle region wall 1126 expands, this causes a gap G to form between the cam 1104 and the plate 1140. This gap G allows the buckle region wall 1126 to expand (spring out), increasing the volume in the cavity of cup 1101 to V2, as illustrated in FIG. 11C. In embodiments, the cam may then continue rotation to restore the cavity to default position shown in FIG. 11A. Since, in the example, the varied volume of the cavity is never less than the initial volume (V1) at start time, no pressure above the reference pressure (start pressure) is generated in the chamber. In other words, only pressure at or below the reference pressure is generated. Such an embodiment is referred to as a "negative pressure" embodiment.

As the buckle region wall 1126 of cup 1101, expands or "springs out," the buckle region wall 1126 causes a thud force, or a "thudding effect," that is imparted to the labia of the user via the cup 1101, creating a pleasurable effect for the user. Wings 118*a*-118*c* (e.g., FIG. 1A), if present, may assist with imparting the force to the labia.

Figure 12:
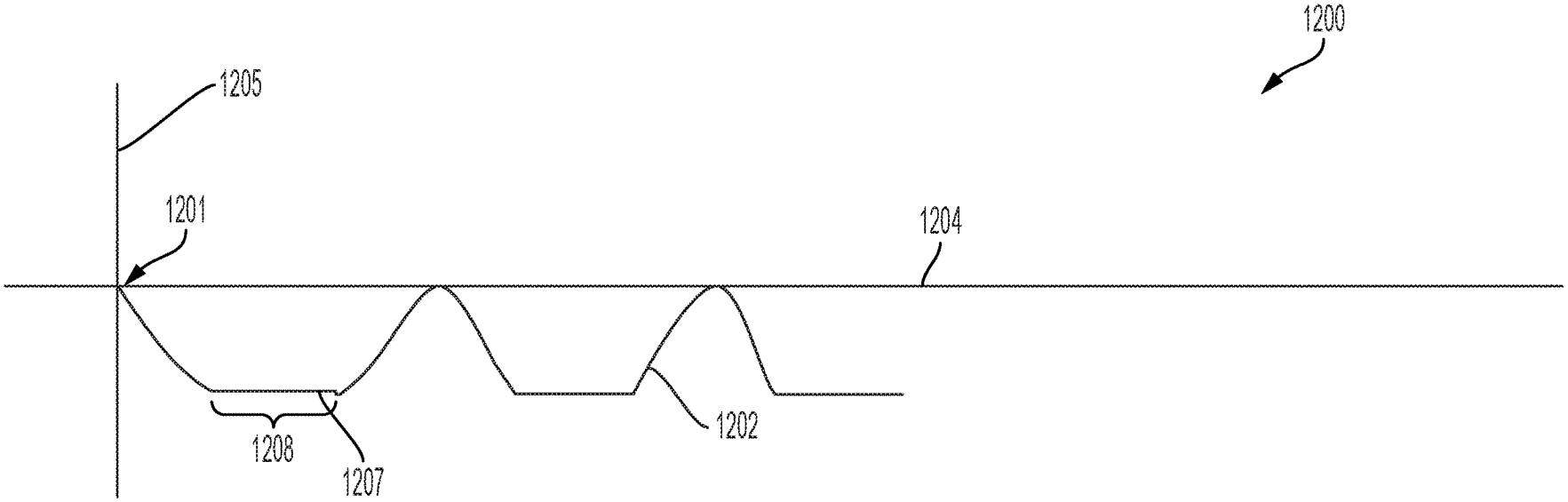
FIG. 12 shows a pressure curve over time graph.

FIG. 12 shows a pressure curve over time graph 1200 for the embodiment shown in FIGS. 11A-11C where buckle region wall 1126 is in compressed position at TO. Graph 1200 comprises vertical axis 1205 representing pressure, and horizontal axis 1204 representing time. Zero on the vertical axis indicates gauge pressure at atmosphere. Pressure curve 1202 does not extend above the gauge pressure 1204. From starting point 1201, the pressure gets more negative until point 1207, and then returns to the original pressure, and the cycle repeats. Note that the sine wave is disrupted, at area such as 1208, when the buckle region (1126) springs out.

Figure 13:
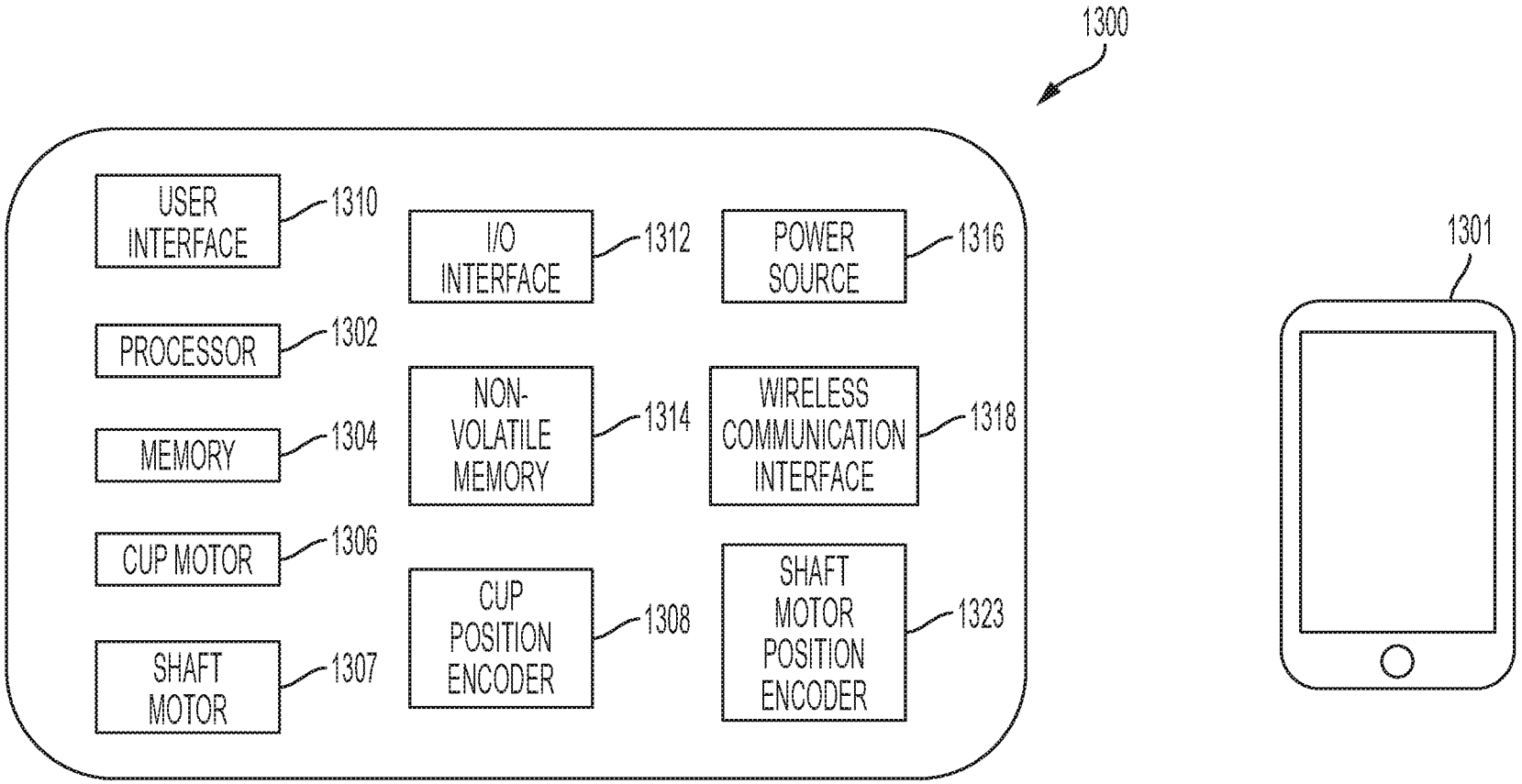
FIG. 13 is a block diagram of an embodiment of a stimulation device of the present invention.

FIG. 13 is a block diagram 1300 of an embodiment of a stimulation device of the present invention. The stimulation device includes a processor 1302 and memory 1304. Memory 1304 may be a computer-readable medium such as flash, battery-backed static RAM, or other suitable computer-readable medium. In some embodiments, the memory may be non-transitory. The memory 1304 contains instructions, that when executed by the processor 1302, perform steps in accordance with embodiments of the present invention. For example, in some embodiments, the memory contains instructions, that when executed by the processor, cause a driver to intermittently vary a volume of the cavity of the cup from a first volume to a second volume. In some embodiments, the memory contains instructions, that when executed by the processor, cause a driver to intermittently vary a volume of the cavity of the cup from a first volume to a second volume without varying the volume from the second volume to the first volume.

The stimulation device may include an onboard input/output interface 1312. This may include one or more input, output, and/or bidirectional pins for control of the stimulation device. User interface 1310 may include one or more buttons, switches, knobs, or other suitable controls disposed on the stimulation device. The buttons may be configured to create a signal on one or more input pins of the I/O interface 1312. The processor may utilize interrupt service routines or monitoring loops to detect button presses and change the operation of the cup motor 1306 accordingly. A position encoder 1308 may be internal to the cup motor 1306, or external to the cup motor 1306, in some embodiments. In an alternative embodiment current peaks and valleys may be used to control the position of the motor.

User interface may include a power on/off and one or more buttons, or a slider to vary the speed of the cam. Accordingly, a user may modify the strength of the pressure field via user input. Various settings are associated with corresponding speeds of the driver (e.g., rotations per minute of the cam). Accordingly, a user may choose that the stimulation device generate greater or lower pressure for their comfort level. The higher the speed, generally, the more intense the stimulation. The stimulation device may include non-volatile memory 1314 for storing user settings.

In some embodiments, instead of or in addition to an onboard user interface 1310, the stimulation device may include a wireless communication interface 1318. The wireless communication interface 1318 may include a Bluetooth®, WiFi, or other suitable interface. The wireless communication interface allows pairing with an electronic device 1301 such as a dedicated remote controller, smartphone, tablet computer, or other electronic device. In some embodiments, the electronic device enables a rich user interface display, allowing for more complex programming options. Wireless communication interface 1318 may be in communication with a transceiver in the electronic device 1301. The stimulation device may be controlled by the user via an application on the smartphone or computer. Some embodiments may not have all of the aforementioned components.

The stimulation device further includes a power source 1316. In embodiments, the power source 1316 can include a battery. The battery can be a replaceable, or internally sealed rechargeable battery. In some embodiments, battery may be USB-chargeable, inductively chargeable, or other suitable charging mechanism now known or hereafter developed. It should be recognized that any power source, now known or hereafter developed, may be used. More than one battery may be included in some embodiments. In some embodiments, the stimulation device may be powered by alternating current power, such as 120V or 240V standard household power, with a power adapter comprising voltage regulators to convert the power to an appropriate DC level (e.g. 12V DC).

In some embodiments of the stimulation device, in addition to the pressure field stimulator, there is a second stimulator. The second stimulator may be mounted within a shaft. The second stimulator may have a motor 1307. Motor 1307 may be a geared motor mechanism that may have, e.g., an asymmetrical load affixed to a rotating shaft, a linear resonant actuator, or a pancake vibration motor, etc., for causing stimulation by, for example, a vibration pattern. In some embodiments, the second stimulator can be a vibrator, a pulsator, gyrator, oscillator, or other suitable mechanism. Accordingly, the stimulation action may of the second stimulator may be vibration, pulsation, gyration, oscillation, massage (such as "come hither" type motion), or another. A position encoder 1323 (or other suitable control) may be internal to the motor 1307, or external to the motor 1307. It will be recognized that any suitable stimulation mechanism now known or hereafter developed may be substituted for, or used in addition to, the examples disclosed herein without departing from the scope and purpose of the present invention.

Figure 14B:
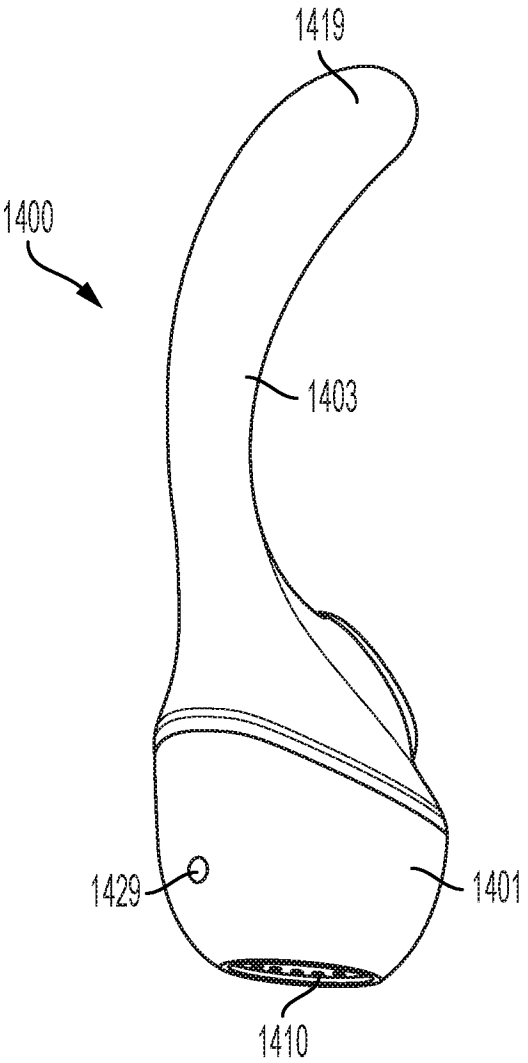
FIG. 14B shows a rear perspective view of the stimulation device of FIG. 14A.
Figure 14A:
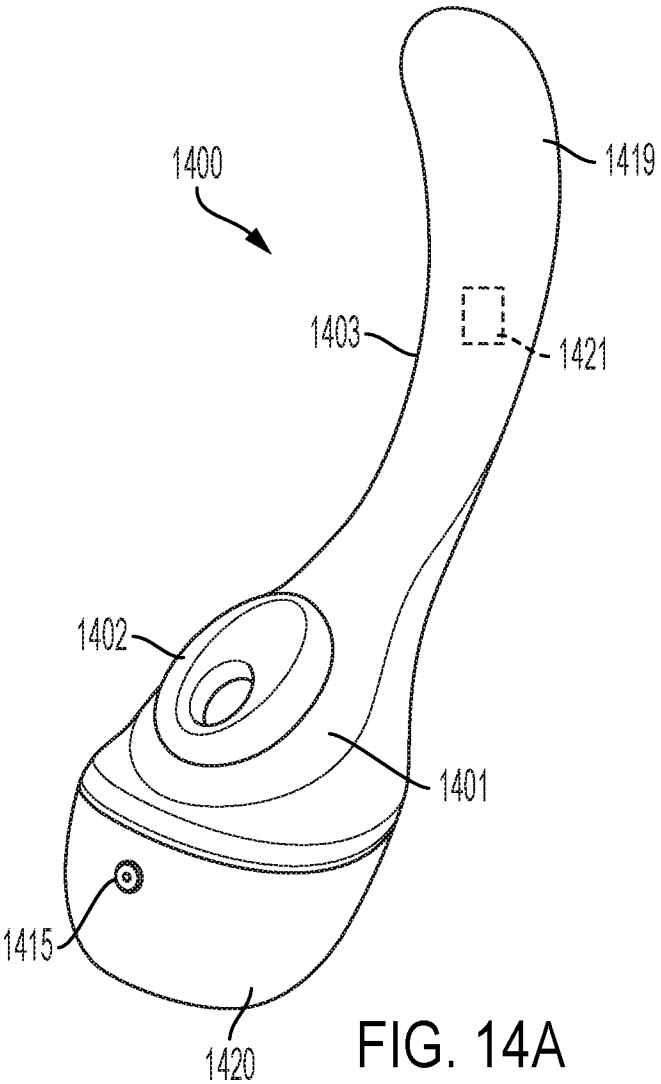
FIG. 14A shows a front perspective view of a stimulation device in accordance with some embodiments of the present invention.

FIG. 14A shows a front perspective view of a stimulation device 1400 in accordance with some embodiments of the present invention. FIG. 14B shows a back perspective view of a stimulation device 1400 in accordance with some embodiments of the present invention. In embodiments, the device 1400 has a shaft 1419 and pressure field stimulator 1401. The pressure field clitoral stimulator 1401 has a cup 1402 and driver components (installed within housing 1420). The shaft 1419 may be covered in a sheath 1403 such as silicone, TPE, or other suitable material. It is preferable that the material be non-permeable. Shaft 1419 is adapted for insertion into a vagina or anus of a user. In some embodiments, shaft 1419 is an elongate shape. A shaft of any suitable insertable shape is included within the scope of embodiments of the invention. In some embodiments, housing 1420 and shaft 1419 is made from plastic, metal, or other suitable (preferably non-porous) material. Sheath 1403 may extend over housing 1420. The shaft 1419 may include a second stimulator, including one or more of a vibrator, oscillator, gyrator, pulsator, and/or massaging stimulator, represented generally as 1421. User interface 1410 includes buttons and other controls for the driver, and shaft (second) stimulator if present. Some embodiments provide simultaneous clitoral and G-spot stimulation. The device may be used hands-free such that after insertion of the shaft and positioning of the pressure field stimulator, the user can take their hands off the device during usage. In some embodiments, some components of the second stimulator are disposed within the housing 1420 of the pressure field stimulator. A power button 1415 is in view in FIG. 14A. User interface 1410 and charging port 1429 are in view in FIG. 14B.

Figure 15:
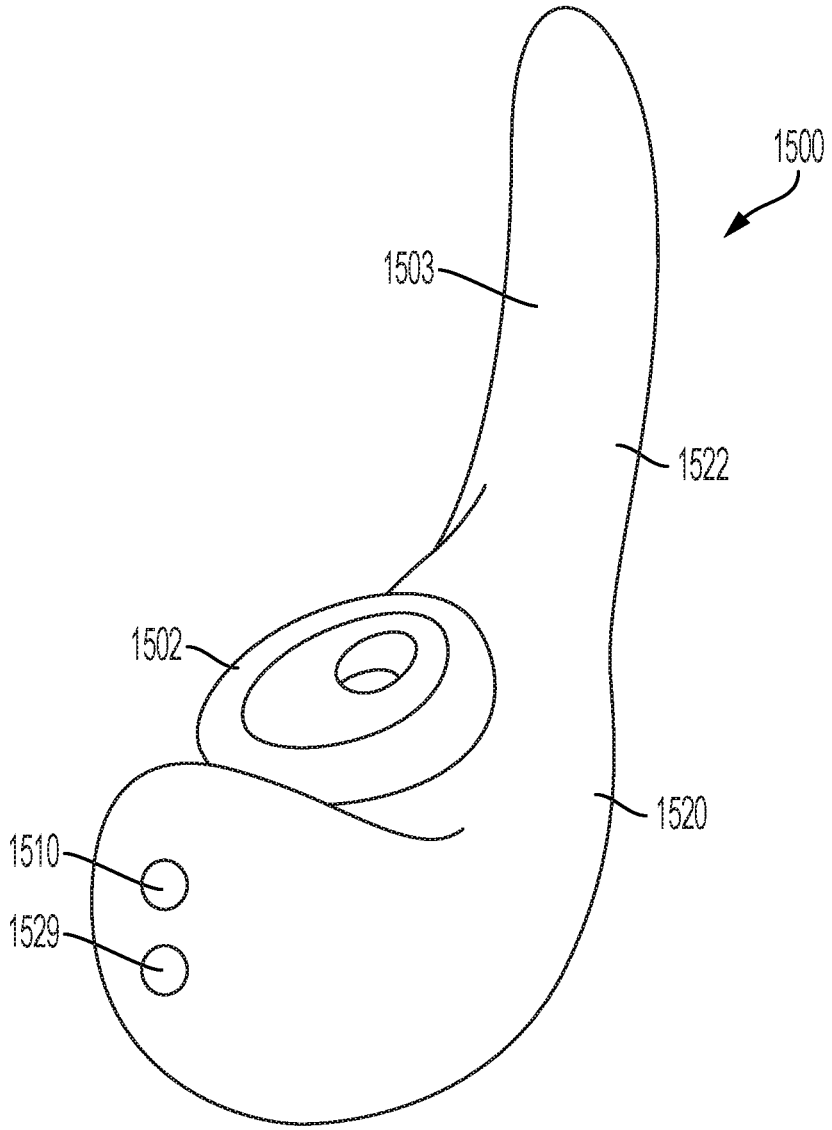
FIG. 15 shows another embodiment of a pressure field stimulation device in accordance with some embodiments of the present invention.

FIG. 15 shows another embodiment of a pressure field stimulation device 1500 in accordance with some embodiments of the present invention. Pressure field stimulation device 1500 includes housing 1520 with cup 1502 installed thereon. Driver components are installed therein. A handle 1522 is affixed to, or integral with, housing 1520 to enable a user to hold (in a hand) and/or manually position the stimulation device during use. In some embodiments, the handle 1522 may be curved such that the user can conveniently hold the stimulation device during use. In such embodiments, the device is hand-held during usage. In some embodiments, the housing 1520 and handle 1522 is made of plastic, metal, or other suitable (preferable non-porous) material. A sheath 1503 of silicone, TPE, or other suitable material may be disposed on the exterior of the housing 1520 and handle 1522. User interface 1510 includes at least one button or other control for the stimulation device. Charging port 1529 is in view.

Figure 16A:
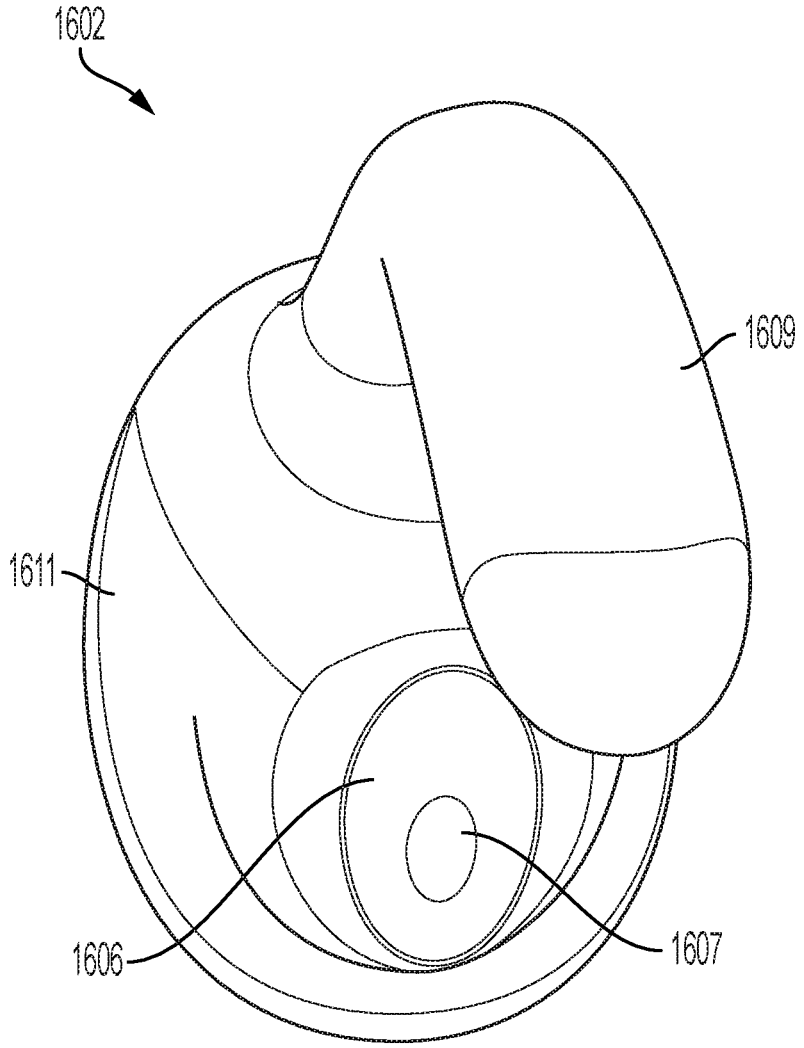
FIG. 16A shows a top-down view of an example sheath.

FIG. 16A shows a top-down view of an example sheath 1602. In embodiments, the sheath 1601 is disposed over at least a portion of the housing (base) of the pressure field stimulator, as well as handle or shaft if present. The sheath 1602 is flexible, resilient, and elastic, and stretches over and attaches to the housing of the pressure field stimulator of embodiments with a tight fit. The example shown includes shaft portion 1609 that stretches over a shaft or handle. In some embodiments, the sheath 1602 is made of silicone, rubber, TPE, plastic or other flexible and elastic material. The cup 1606 includes cavity 1607. The cup 1606, in some embodiments, is molded into, or integral with, the sheath such that the sheath and cup are a single piece and not two pieces. In some embodiments, the sheath and cup consist of a single piece of material. In such embodiments, the cup and sheath may be injection molded via a single mold such that the resulting cup-sheath is a single piece and not made of two pieces. Note that injection molding is an example process, and any suitable method of making is included within the scope of the invention.

Figure 16B:
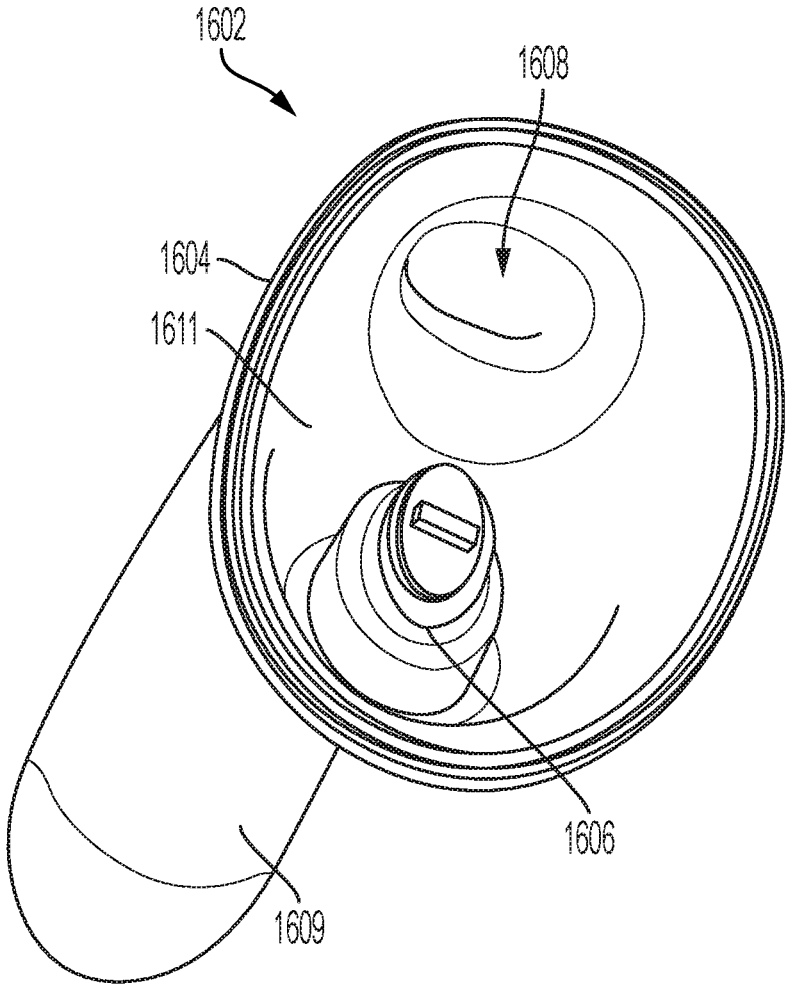
FIG. 16B shows a bottom-up view of the sheath of FIG. 16A.

FIG. 16B shows a bottom-up view of sheath 1602, illustrating the interior of the sheath. During assembly of disclosed embodiments, an interior shaft opening 1608 is configured and disposed to receive a shaft or handle. An attachment point 1604 is formed around the base portion 1611. In embodiments, attachment point 1604 comprises a raised lip (protrusion) of material.

Figure 17:
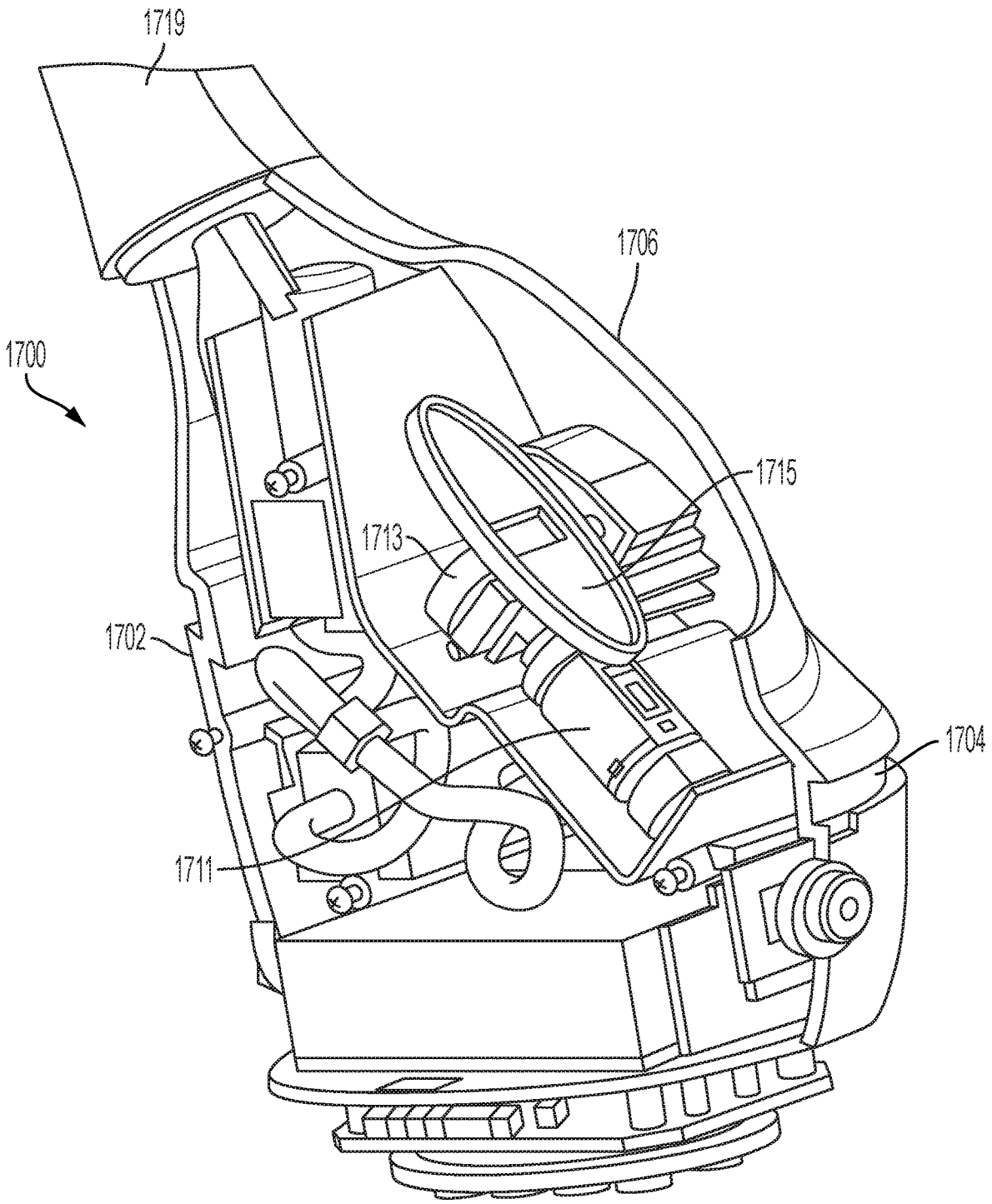
FIG. 17 shows a partial view of the internal components of a pressure field stimulator in accordance with embodiments of the invention.

FIG. 17 shows a partial cut-away view of the internal components of a base including a pressure field stimulator 1700 in accordance with some embodiments of the invention. In some embodiments, a shaft or handle is attached, a portion thereof is shown at 1719. The sheath 1602 is attached to the pressure field stimulator 1700 in any suitable way. In some embodiments, it may be via reciprocal grooves and protrusions on the housing and sheath noted as attachment point 1604 on the sheath 1602 and attachment point 1704 on the housing. The sheath 1601 may be adhered, instead or in addition, to the reciprocal grooves and protrusions. A portion of the housing 1702 and groove 1704 where the sheath 1602 attaches is in view. The pressure field stimulator 1700 includes a housing 1702 that houses internal components, including, but not limited to, motor(s), pump (s), batteries, circuits, and/or other components. Inside the housing is shown a motor 1711, cam 1713, and plate 1715. An attachment point, such as groove 1704, is formed within the housing 1702 that is configured and disposed to receive attachment point 1604 (FIG. 16B) of the sheath 1602. The housing 1702 may further include at least one support flange 1706, which provides mechanical support for the base portion 1611 and/or cup 1606 of the sheath 1602. In some embodiments, the width of the groove 1704 and the width of protrusion 1604 are sized such that a tight friction fit forms between them when the attachment point 1604 is applied to groove 1704. In some embodiments, the sheath 1602 may be removable by the user to facilitate cleaning. In other embodiments, the sheath 1602 may be permanently affixed to the housing 1702 via adhesive, sealant, or other suitable technique.

Some embodiments are waterproof such that they may be washed with fluids, like soap and water. Accordingly, the attachment points of the sheath and any other external portions are sealed where necessary. This allows a user to clean the device thoroughly between insertions.

The pressure field stimulation device is unitary in structure, meaning the components thereof together form a single product, rather than multiple products which may be used together by a user.

While the invention has been particularly shown and described in conjunction with exemplary embodiments, it will be appreciated that variations and modifications will occur to those skilled in the art. The embodiments according to the present invention may be implemented in association with the formation and/or processing of structures illustrated and described herein as well as in association with other structures not illustrated. Moreover, in particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. A stimulation device, comprising:

a cup formed of a flexible resilient material comprising a cavity; and a driver, the driver comprising:

a plate disposed on an underside of the cup;

a cam disposed adjacent to the plate;

a motor mechanically coupled to the cam;

wherein the cam is not permanently connected to the plate.

2. The stimulation device of claim 1, wherein:

the driver is configured to intermittently vary a volume of the cavity of the cup from a first volume to a second volume without returning the volume of the cavity of the cup from the second volume to the first volume.

3. The stimulation device of claim 2, wherein the cup is configured such that the cavity returns from the second volume to the first volume, in between intermittent repetitions of the varying, without assistance from the driver.

4. The stimulation device of claim 2, wherein the cup is configured such that the cavity returns from the second volume to the first volume, in between intermittent repetitions of the varying, only due to the flexible resilient material of the cup.

5. The stimulation device of claim 2, wherein the cup is configured such that the cavity returns from the second volume to the first volume, in between intermittent repetitions of the varying, without electrical assistance or mechanical assistance from a device or article external to the flexible resilient material.

6. The stimulation device of claim 2, wherein the second volume is smaller than the first volume.

7. The stimulation device of claim 2, wherein the second volume is larger than the first volume.

8. The stimulation device of claim 1, wherein the plate is rigid.

9. The stimulation device of claim 1, wherein the stimulation device is a sex toy.

10. The stimulation device of claim 1, wherein the stimulation device is a pressure field stimulator.

11. The stimulation device of claim 1, wherein the driver further comprises a motor shaft guide; and wherein the plate comprises a cam strike.

12. The stimulation device of claim 1, wherein the cavity is formed of a single section.

13. The stimulation device of claim 1, wherein the cavity is formed of two or more sections separated by a flange such that air can pass through the two or more sections.

14. The stimulation device of claim 1, wherein the cam is a shape of: circle, oval, lobe, or polygon.

15. The stimulation device of claim 1, further comprising a sheath that is disposed over a housing of the stimulation device, wherein the cup and the sheath together consist of a single piece of material.

16. The stimulation device of claim 1, wherein the cup is oval or round in shape.

17. A stimulation device, comprising:

a cup formed of a flexible resilient material comprising a cavity;

a driver, the driver comprising:

a plate disposed on an underside of the cup;

a cam disposed adjacent to the plate; and a motor mechanically coupled to the cam;

a processor; and a memory containing instructions that when executed by the processor cause the driver to intermittently vary a volume of the cavity of the cup from a first volume to a second volume.

18. The stimulation device of claim 17, wherein:

the driver is configured to intermittently vary the volume of the cavity of the cup from the first volume to the second volume without returning the volume of the cavity of the cup from the second volume to the first volume.

19. The stimulation device of claim 18, wherein the cup is configured such that the cavity returns from the second volume to the first volume, in between intermittent repetitions of the varying, without assistance from the driver.

20. The stimulation device of claim 18, wherein the cup is configured such that the cavity returns from the second volume to the first volume, in between intermittent repetitions of the varying, without electrical assistance or mechanical assistance from a device or article external to the flexible resilient material.

21. The stimulation device of claim 17, wherein the second volume is smaller than the first volume.

22. The stimulation device of claim 17, wherein the second volume is larger than the first volume.

23. The stimulation device of claim 17, wherein the plate is rigid.

24. The stimulation device of claim 17, wherein the stimulation device is a sex toy.

25. The stimulation device of claim 18, wherein the cup is configured such that the cavity returns from the second volume to the first volume, in between intermittent repetitions of the varying, only due to the flexible resilient material of the cup.

* * * * *